US006091055A

United States Patent [19]

Naka et al.

[11] Patent Number: 6,091,055

[45] Date of Patent: Jul. 18, 2000

[54] METHOD OF HEAT TREATING OBJECT AND APPARATUS FOR THE SAME

[75] Inventors: Hiroyuki Naka, Osaka; Makoto Morita, Nishinomiya; Yuji Tsutsui, Hirakata; Naomi Nishiki, Kyoto; Hiroaki Ishio, Daito, all of Japan

[73] Assignee: Matsushita Electric Industrial Co., Ltd., Osaka-fu, Japan

[21] Appl. No.: 09/127,825

[22] Filed: Aug. 3, 1998

[30] Foreign Application Priority Data

Aug. 4, 1997 [JP] Japan ..... 9-208824

[51] Int. Cl.[7] ..... F27B 9/06

[52] U.S. Cl. ..... 219/388; 432/120; 432/121; 29/81

[58] Field of Search ..... 219/388; 432/120, 432/147, 135, 121, 134; 392/375; 29/DIG. 81, DIG. 78

[56] References Cited

U.S. PATENT DOCUMENTS

| | | | |
|---|---|---|---|
| 3,752,643 | 8/1973 | Robinson | 432/120 |
| 3,807,943 | 4/1974 | McKinstry | 432/135 |
| 3,820,946 | 6/1974 | Miyoshi et al. | 432/121 |
| 4,501,553 | 2/1985 | Imose et al. . | |
| 4,518,848 | 5/1985 | Weber | 219/388 |
| 4,667,076 | 5/1987 | Amada | 219/10.55 M |
| 4,674,975 | 6/1987 | Corato et al. | 432/11 |
| 4,770,630 | 9/1988 | Akimoto et al. | 432/121 |
| 5,320,329 | 6/1994 | Hoetzl et al. . | |

FOREIGN PATENT DOCUMENTS

| | | |
|---|---|---|
| 0 095 980 | 12/1983 | European Pat. Off. . |
| 61-187341 | 8/1986 | Japan . |
| 61-267394 | 11/1986 | Japan . |
| 62-180858 | 8/1987 | Japan . |
| 62-180871 | 8/1987 | Japan . |
| 63-37352 | 2/1988 | Japan . |
| 63-133693 | 6/1988 | Japan . |
| 1-173735 | 7/1989 | Japan . |
| 1-271356 | 10/1989 | Japan . |
| 2-1867 | 1/1990 | Japan . |
| 2-70617 | 3/1990 | Japan . |
| 2-76242 | 3/1990 | Japan . |
| 2-89721 | 3/1990 | Japan . |
| 3-101119 | 4/1991 | Japan . |
| 4-26118 | 1/1992 | Japan . |
| 4-269143 | 9/1992 | Japan . |
| 5-29238 | 2/1993 | Japan . |
| 5-226214 | 9/1993 | Japan . |
| 6-127738 | 5/1994 | Japan . |
| 7-115120 | 5/1995 | Japan . |
| 1038088 | 8/1966 | United Kingdom . |
| 1 367 382 | 9/1974 | United Kingdom . |
| 2 020 401 | 11/1979 | United Kingdom . |
| 2 020 401 A | 11/1979 | United Kingdom . |
| 1 238 455 | 7/1991 | United Kingdom . |
| 2 265 580 A | 11/1993 | United Kingdom . |
| 2 266 580 | 11/1993 | United Kingdom . |
| 85/0086 A1 | 1/1985 | WIPO . |

OTHER PUBLICATIONS

"Type of Industrial of Furnace for Transporting Materials" by Keizo Kinoshita, pp. 2–5, Kogyoro–nokisochishiki (Basic Knowledge of Industrial Furance) published by Japenese Industrial Furance Association (Feb. 15, 1993)—partial English translation.

Catalog prepared by Sora–risachi–kenkyusho, Solar Research Laboratory, "Float–chuck", Apr. 1997—English language abstract.

*Primary Examiner*—Teresa Walberg
*Assistant Examiner*—Shawntina Fuqua
*Attorney, Agent, or Firm*—Wenderoth, Lind & Ponack, L.L.P.

[57] ABSTRACT

In the heat treating method and the heat treatment apparatus of the object, the object is heat treated while it is being floated by gas expelled toward the object from a position below the object in the heating chamber.

54 Claims, 15 Drawing Sheets

METHOD OF HEAT TREATING OBJECT AND APPARATUS FOR THE SAME

BACKGROUND OF THE INVENTION

1. Field of the Invention

The present invention relates to a method and an apparatus for heat treating an object, and particularly for heat treating a starting material or an intermediate product for the production of a final product or for the treatment of various products.

2. Related Art

Various heat treatments are used for the production of various products. For example, by heat treatment of an object a number of effects can be obtained such as drying, dehydration, calcination, reaction acceleration, surface modification and so on. In order to improve the efficiency of the heat treatment, an object to be heat treated is passed through a heating chamber in the form of a dome or a tunnel while the object is moved using a conveyer.

An apparatus which carries out such a heat treatment includes a heating zone where temperature of a object is increased to a temperature at which a thermal treatment is started, and a thermally treating zone where such an object of which temperature has been just increased is subjected to predetermined conditions for the thermal treatment (for example, a constant temperature for a predetermined period, or a predetermined temperature change from the increased temperature). There may be no clear border between these two zones. In the present specification, the term "heat treatment (or heat treating)" is intended to include both or either of the temperature increasing treatment in the heating zone and the thermal treatment in the thermally treating zone, which are explained just above. In addition, the apparatus which carries out such a heat treatment usually further includes, at the back of the thermally treating zone, a cooling zone where the object is cooled to a predetermined temperature after the heat treatment. The object passes through these three zones in turn.

With respect to the above heat treatment, there is an energy utilization efficiency problem in that a ratio of an amount of heat energy which is truly used to heat treat the object itself to an amount of heat energy which is supplied to the heat treatment apparatus is small. This means that most of the supplied heat energy is wasted. This problem leads to a high cost for the heat treatment.

In the conventional method for the heat treatment as explained above, the following would be possible reasons for the low heat energy consumption efficiency.

Since an inlet and an outlet of the tunnel shaped heating chamber are always open to the outside, a portion of heat energy supplied to the heating chamber is lost through the inlet and the outlet. An amount of the heat energy lost through the inlet and the outlet is said to be about 30% of the supplied heat energy to the heating apparatus.

In the heating chamber and the conveyer in addition to the object is heated a large amount of heat energy is required to heat up a moving mechanism such as the conveyer. The moving mechanism such as the conveyer is complicated and its heat capacity is large. Thus, a large amount of heat energy is required to heat up the mechanism. The conveyer moves the object from before the heat treatment to after the heat treatment. When the conveyer leaves the heating chamber, heat energy supplied to the conveyer in the heating chamber is taken out to the outside of the heating chamber. Every time the conveyer goes into and out from the heating chamber, a large amount of heat energy is supplied to the conveyer and lost into the outside without being used. An amount of the heat energy lost through the conveyer is said to be about 20% of the heat energy supplied to the heating apparatus.

In addition, an amount of heat which is lost through a wall of the heating chamber to the outside thereof is also large. The amount of the heat energy loss through the wall of the heating chamber is said to be about 45% of the heat energy supplied to the heating apparatus.

Thus, it is said that an amount of heat energy which is substantially used for the heat treatment of the object is only about 5% of the heat energy supplied to the heating apparatus.

SUMMARY OF THE INVENTION

It is therefore an object of the present invention to overcome the above problem in the method of the heat treatment in the prior art so that utilization efficiency of the heat energy is improved.

The present invention provides a method of heat treating an object which method is characterized in that the object is heat treated as aimed while the object is being floated in a heating chamber by expelling gas toward the object from a position below the object.

DETAILED DESCRIPTION OF THE PREFERRED EMBODIMENTS

Figure 1:
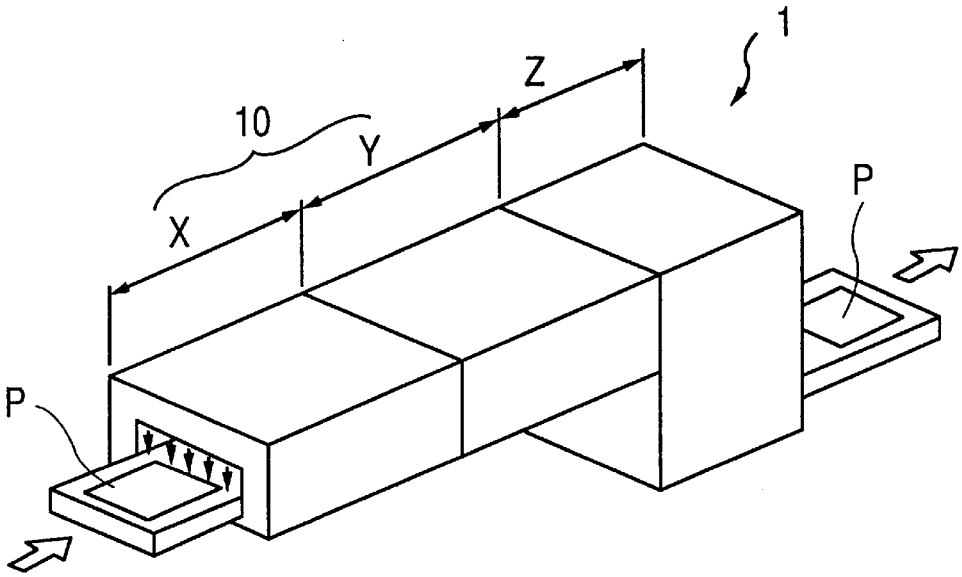
FIG. 1 schematically shows a perspective view of a heat treatment apparatus which is used in a method of heat treating according to the present invention.

In the present invention, heat treatment (or heat treating) may be any treatment in which heat is added (or supplied) to the object, so that at least one characteristic (for example, water content, electrical resistance, permeability, a formed film thickness or its uniformity, and stress thereof) of the object is predeterminely changed. For example, the heat treatment includes a treatment in which temperature of an object is increased to a predetermined temperature in a predetermined period, a treatment in which the temperature of the object is kept at a predetermined temperature for a predetermined period and/or a treatment in which the object is subjected to a predetermined temperature change. The heat treatment is a process in which heat is supplied as described above, but the heat has to be not always supplied to the object. Thus, there may be a period during which not heat is supplied. Thus, when no heat is supplied, the temperature of the object (or the heat treating temperature) may be decreased due to heat loss.

The term "object" means an item to which the heat temperature is applied. The object may be in any form, and thus it may have a complicated form. Generally, the object is a plate, sheet or film form as a whole. The object may have a continuous form (such as an elongated (long) band) or a divided form having a fixed size (or length). It is generally preferable that the object has a considerably large horizontal dimension (i.e., a width or a length) relative to a dimension which is perpendicular to the horizontal dimension (i.e., thickness of the object). In the present specification, the term "horizontal" corresponds a direction over which main surfaces defining the object in the sheet form extend. The either or both of the main surfaces defining the object may include irregularities thereon, and the object is preferably in the form of a sheet overall.

A material which constitutes the object is not particularly limited and it may be any material. For example, the object may be made of ceramic, glass, metal, resin and/or any other structural material. Further, any combination of these materials is also possible for the object. In one embodiment, the object may be formed by combining two objects as described above, and in this case, the object may be in the sheet form or in a more complicated form.

Concretely, the heat treatment includes for example drying, dehydration, calcination, reaction, reaction acceleration, surface modification, sintering, firing, thermosetting, thermally melting, bonding and so on. The objects of those heat treatments include, for example, a semiconductor substrate, plasma display panel (PDP) substrate, a solar cell substrate, a liquid crystal substrate, a CRT (cathode-ray tube) and so on.

In the present invention, that "the object is being floated by expelling the gas toward the object from the position below the object" means that the object is kept in such a condition that the object is floating in an ambient atmosphere around the object. A force which pushes the object upward and which is generated by collision of the gas expelled toward the object from the position below the object (i.e., a dynamic force or a static force of the gas) balances with a gravity force acted on the object, so that the object is floated. Usually, the gas is expelled through a blowing opening perpendicularly toward a button surface (i.e., a black surface) of the object from the position below the object, so that the object is to be shifted and kept floating. In addition to the bottom surface of the object, it is possible to control posture of the object by expelling gas toward also a top surface and/or a side surface of the object.

Further, when the direction along which the gas is expelled toward the object is diagonal, other than perpendicular, such gas applies a force onto the object. The force is divided into a horizontal component force and a perpendicular (or vertical) component force. The horizontal component force tries to move or moves the object when it is in a stopping condition, or functions such that the movement of the object is accelerated or suppressed depending on an acting direction of the horizontal component force onto the object when the object is in a moving condition. For example, when the gas is so expelled toward the moving object that an component force of which acts in a direction that is opposite to the moving direction of the object is applied to the object, the moving object is slowed down or stopped. The perpendicular component force is used for floating the object.

Gas expelling (or blowing) is carried out by supplying the gas through a hole, which acts as a blowing opening towards the object. Usually, a plurality of and preferably many blowing openings are provided at positions above which the object is present or to be present (i.e., on a path over which the object moves) in the heating chamber, and the gas is expelled in the same direction or in various directions through the blowing openings. In the latter case, when a resultant force of the various forces which are generated by the gas blown through the blowing openings and which act to push the object has a horizontal component force, the object is moved along the direction of the horizontal component force.

Concretely, the blowing openings may be provided at a plurality of positions in the heating chamber so that the gas is expelled toward and perpendicular to the object at a plurality of positions on the bottom surface. In another embodiment, the blowing openings may be so provided in the heating chamber that some of them expel the gas upward and perpendicularly to the object and the other expel the gas diagonally and upward. Those skilled in the art can easily to select how the gas should be expelled (i.e., how the blowing openings are arranged) depending on how the object is to be floated and to be moved if necessary based on the disclosure herein.

Therefore, in the method of the heat treatment according to the present invention, the object may be moved during the heat treatment while being floated as described above, or the object may be stopped (or halted) during the heat treatment while being floated. In addition, combination of being halted and being moved while the object is floated is also possible. For example, the heat treatment may comprise a sequence of heat treatments of the object while it is moved after it has been heat treated, while it has been halted, or it may comprise its a reversed sequence. Whether the object which is being floated is moved or stopped depends on a type of the required heat treatment for the object.

In the present invention, the term "move" and "stop" respectively relate to the presence and the absence of a substantial length along which the object is horizontally moved. The term "stop" means that the object does not move at least horizontally (thus, the object may or may not move perpendicularly). The term "move" means that the object moves at least horizontally (thus, the object may or may not move perpendicularly).

When the predetermined heat treatment is carried out over an extended period, it may be preferable that the object is stopped during the heat treatment while being floated, after which the object is moved, so that a small heating chamber can be used. When the predetermined heat treatment is carried out over a short period, it may be preferable to carry out the heat treatment while the object is moved continuously (preferably at a constant speed) in the heating chamber, so that treatment efficiency is improved. Alternatively, these two heat treatment modes may be combined, namely, the heat treatment is carried out when the object is stopped and also when the object is moved.

In another embodiment, the object is moved by gas while it is floated and the heat treatment itself may be carried out in such a condition that the objectis not floated (for example, the object is perpendicularly and mechanically supported). In one preferable embodiment, the object may be moved with mechanical application of a force thereto while the object is being floated in the heating gas chamber by the gas. In this embodiment, the heat treatment may be carried out when the object is moved and/or stopped.

The gas which floats the object may be any gas provided that it does not adversely affect the heat treatment or it accelerates the heat treatment. Generally, air (a gas which constitutes atmosphere for the heat treatment, for example), an inert gas such as nitrogen, a reactive gas, a mixture of these gases and so on may be used. The gas is preferably heated appropriately depending on the temperature of the heat treatment. When the gas is heated beforehand, the heat treatment and the object floating both can be carried out by the same gas. A combustion gas, which has a high temperature, may be used provided that it does not adversely affect the object.

As explained above, the gas is expelled through the blowing opening toward the object, and the blowing opening is not particularly limited, provided that the gas is supplied through the blow opening toward a predetermined direction so as to apply a predetermined force to the object. The blowing opening may be a nozzle, a slit, a mesh and so on, and its cross-section is also not limited. For example, the cross-section of the blowing opening may be a circle, an oval, a rectangle and so on. Usually, a plurality of and preferably many of the blowing openings are provided on a path over which the object is to be moved in the heating chamber, so that the object can pass through the heating chamber while it is floated.

Generally, the blowing openings are arranged in rows and/or columns on the moving path of the object (namely, in series along and/or perpendicular to the moving path of the object). For example, the blowing openings are provided in a waffle-like pattern. The number of the blowing openings and their arrangement are properly selected depending on the heating chamber (particularly, the moving path of the object including its length and width and so on), the object to be heat treated (particularly, its weight (weight per unit area) and width) and height to be floated. It is noted that the height to be floated (that is, the distance between the object and the blowing opening) may be any height as far as the object is moved smoothly. Usually, the height is in the range between about 0.1 mm and about 20 mm. Considering the lower cost with respect of a small amount of gas consumption for floating and the improved reliability of the object movement with respect to thermal deformation of the object, the height may be is preferably in the range between about 0.5 mm and about 3 mm.

When the above described mode is employed in which the object is floated by the gas (i.e., an object floating mode), substantially only the blowing openings and conduit systems therefor are provided in the heating chamber. A gas supplying system (for example, pumps, valves, control systems and so on) may be provided outside the heating chamber, so that facilities in the heating chamber become very simple. As a result, the number of breakdowns of the heat treatment apparatus decreases and maintenance of the apparatus is easy. In other words, the object floating mode is advantageous in a complicated working mechanism does not have to be placed in the heating chamber.

It is noted that moving the object by the gas as described above itself is known from, for example, Japanese Patent Kokai Publication Nos. 61(1986)-267394, 2(1990)-76242 and 5(1993)-29238. The contents of these publications are incorporated herein by reference.

In one preferable embodiment of the present invention, a mechanical means (or force) other than the gas blowing is used for the movement of the object. When the temperature of the heat treatment is high, density of the gas becomes small. Thus, in this case if the object movement in addition to the object floating is attempted by using the gas, large amounts of the gas may be necessary. In such a case, only the object floating is carried out by the gas, and the horizontal object movement is carried out by the mechanical force.

For example, when a mechanical impulse force is applied to the object in a direction along which the floating object is to be moved (for example, the object is simply pushed), the object is going to move along the direction of the force application. When the object is moving, the gas is expelled toward the object in turn from the blowing openings which are provided on the moving path of the object and the blowing openings on the path to which the object is approaching so that the expelled gas from the blowing openings in turn supports the moving object. The object is in contact with only the gas and friction between the object and the gas is small. Further, the gas expelled upward functions as a kind of bearings under the object. The object can move over at least some distance by the initial pushing force depending on the available conditions. Usually, the moving speed of the object gradually decreases and the object finally stops. In order to stop the object which is moving, a barrier member may be provided at a position on the path which the object is going to pass, so that the object which is coming to that position collides with the barrier member and stops. The kinetic energy of the object is absorbed by the barrier member.

It is noted that changing the magnitude of the pushing force can change the moving speed and/or the moving distance of the object. The mechanism and construction for pushing and stopping the object as described above are relatively simple (for example, the mechanism may be a simple structure), and the force to be applied is small.

In another embodiment, at least one abutting member (or a stop member) is provided in the heating chamber. The member moves along the same direction as that of the path over which the object is to be moved. The abutting member which so moves abuts against and constrains a portion of the object so that the abutting member continues to push the object along the predetermined direction as long as the abutting member abuts against the object. Since the abutting member constrains the object, the object is stopped by stopping the abutting member. By changing a moving speed of the abutting member, the moving speed of the object in the heating chamber can be controlled. Such an abutting member is provided on a driving means which travels along one side of the moving path of the object in the heating chamber. In a preferable embodiment, the abutting member is provided on the driving means which moves along each side of the moving path of the object. The driving means is preferably continuous such as a chain-belt driven by gears or a belt driven by pulleys. The driving means is preferably as small as possible, and thus it may have a small width when it is in the form of the chain-belt or the other belt. When the driving means is actuated/halted, the abutting member is moved/halted so that the object is moved/halted.

In another embodiment, when the object is continuously heat treated, a plurality of carrying members (for example, carrier tray) are prepared which can be floated by the gas and which are arranged adjacent to one another, and the object is provided in each of those carrying members. The first carrying member is placed at an inlet of the heating chamber, and then the second carrying member is abutted against the first member and a force is applied to the second member so that the applied force is transferred to the first member. Thereby, the first member is moved and pushed into the heating chamber simultaneously with locating the second member at the inlet of the heating chamber. Then, the third member is located adjacent to the second member, and then located at the inlet of the heating chamber as with the second member, so that the carrying members preceding the third member are moved ahead into the heating chamber. The first carrying member is further moved along the direction to be moved, and the second carrying member is pushed into the heating chamber. By repeating these steps, the preceding carrying members are pushed ahead (and thus moved toward an outlet) by the following carrying member in the heating chamber. In this embodiment, the carrying members are in the floating conditions by the gas expelled from below the members in the heating chamber. This manner moving the object using the carrying members can be designated as a plug flow mode (or a one-after-another mode or push mode) in which the following member mechanically pushes the preceding member(s) ahead. In this mode, the object is moved intermittently. Namely, the carrying member which is in the floating condition is moved when the following carrying member is pushed, and after completion of pushing, the movement of the object is stopped.

In order to halt the object (or the carrying member which supports the object) which is moving in various manners as described above, a suction means may be used in addition to or in place of the prescribed halting manners. The suction means is provided at a position where the object is to be halted, and the object is drawn toward the suction means (thus, the object is halted while it is floated). Optionally the object may sit on the suction means. For example, a suction opening is provided which sucks an atmosphere in which the object is floating, and especially sucks gas under the object.

Concretely, the sucking openings are provided at predetermined positions on the object moving path, and the gas around the object is sucked out so that the object, which is going to pass over the sucking opening, is drawn toward the sucking opening and thereby the object is halted. The sucking opening is connected to an evacuation mechanism such as a pump. Upon sucking, when the suction capacity is larger than the force to float the object by the expelled gas, and the object cannot float. Therefore, when sucking is to be carried out while keeping the object floating, an amount of the gas expelled through the blowing openings has to be large enough to keep the object in the floating state. The suction of the suction means is stopped and the amount of the expelled gas required decreases when the object is halted.

As the suction means, a so-called ejector type suction means may be employed which comprises a body member and sliding member. The body member includes a pressurized gas passage and a suction passage. Pressurized gas is supplied at one end of the pressurized gas passage and discharged at the other end. The suction passage is branched off at an intermediate portion of the gas pressurized passage and it is open to the object movement path to form an opening below the suction opening. The sliding member covers (or fitted onto) an end portion of the body member above the portion where the suction opening is located, and freely slides on the end portion along a direction from the body member toward the object and vice versa.

With the suction means, when the pressurized gas passes through the pressurized gas passage, a suction force is generated in the suction passage due to a dynamic force of the pressurized gas, so that gas is evacuated through the suction opening of the sliding member. Upon approach of the object to the suction means, pressure of a gap between the object and the suction means is decreased, so that the sliding member is drawn toward the object. Then, the gap between the object and the sliding member is further narrowed, and the pressure of the gap is further lowered, so that the sliding member is captured by the object. The object is arrested by the body member onto which the sliding means is provided. Thereafter, when the supply of the pressurized gas is stopped, the sliding member returns toward the body member, so that the object can move freely. With such a suction means, when the supply of the pressurized gas is stopped just before the object is arrested by the suction means, the object is halted while it is floated substantially without contact with the suction means.

In the present invention, the object is heat treated while floating and movement when necessary are carried out as described above in the heating chamber. It is noted that a cooling operation is generally carried out after the heat treatment in which operation the temperature of the heat treated object is lowered to a predetermined lower temperature. In such a cooling operation, it is of course possible to optionally employ the floating and the movement of the object as described above.

Thus, the apparatus for the heat treatment according to the present invention comprises the heating chamber containing a heating zone and a thermally treating zone, and optionally a cooling zone. The heating zone is a zone where the object is heated, preferably for a predetermined period, from its original temperature to a predetermined temperature at which a thermal treatment of the object starts. The thermally treating zone is a zone where the object which has been treated to the predetermined temperature is kept at a predetermined thermal treating zone temperature condition, preferably for a predetermined period. The predetermined thermal treating zone temperature condition may be a constant temperature condition or a temperature changing condition as required (including a temperature decreasing condition due to suppression or reduction of heating or any heat loss). Further, the cooling zone is a zone where the temperature of the object which has been thermally treated is cooled from the final temperature of the thermal treatment to a predetermined cooling zone temperature, preferably in a predetermined period.

The heating chamber, in which the object is heated and thermally treated while it passes the heating chamber, may be of the same structure as that of the conventional heating apparatus. Generally, the heating chamber is in the form of a dome or a tunnel (i.e., a cylindrical form) surrounded by an insulating material, wherein the object is placed at an inlet of the chamber and then passed through the chamber. The object is floated by expelling the gas at the inlet of the heating chamber, and thereafter any of the above described manners may be used as to float and move the object. For example, in order to move the floating object, the gas may be expelled diagonally from a position below the floating object, the mechanical force may be applied to the floating object or the object may be placed on the carrying member which is moved in the push mode, or any combination thereof may be employed.

In the heating chamber, the heating means is provided along the object moving path in the heating zone and the thermally treating zone. The heating means may be any means which is conventionally used, provided that it does not adversely affect on the method and the apparatus of the present invention. The number of the heating means and their arrangement may be properly selected depending on a volume of the heating chamber, type of the thermal treatment and so on. The heating means may be all the same, or may be different depending on the purpose of the heat treatment. As to an insulation structure of the heating chamber, an insulation structure of the heating zone may be the same as or different from that of the thermally treating zone.

At the inlet and the outlet of the heating chamber, there may be provided a shield member which suppresses transfer of the gas and the heat from the inside to the outside of the heating chamber. For example, an air curtain as well as a door member which mechanically opens and closes may be provided as the shield member.

It is noted that the cooling zone may be optionally provided downstream of the heating chamber as described above. The object which has been subjected to the thermal treatment may be naturally or forced to be cooled after it has left the heating chamber. These two cooling manners may be combined. The cooling operation may cool the object to a normal temperature or to a predetermined temperature which is higher than the normal temperature.

For the forced cooling, a gas blowing toward the object may be employed. Basically, the temperature of the used gas is lower than the temperature of the object. In a preferable embodiment, the gas is blown in series of steps in which the temperature of the gas to be blown is decreased step by step. Namely, the object is cooled first by the gas having the highest temperature, then cooled by the gas having a lower temperature, then cooled by the gas having a further lower temperature, and so and forth. The object is cooled finally by the gas having the lowest temperature. Thus, the object is cooled stepwise, which makes rapid cooling possible substantially without occurrence of thermal deformation (or strain) in the object.

In order to save an area which is required for installation of the cooling zone on the area, the objects are cooled while they are moving in a stacked arrangement in the cooling zone. Adjacent objects are arranged parallel and the adjacent main surfaces of the adjacent objects are separated by a space. In the cooling zone, the objects are moved along a direction which is perpendicular to the main surfaces of the object (thus, this movement is vertical movement). When compared with a case in which the objects are arranged spreading horizontally (namely, on a plane corresponding to the main surface of the object), the installation area for the cooling zone is reduced.

Therefore, in one embodiment, it is possible to combine the horizontal movement of the object in the heating chamber with the vertical movement of the object in the cooling zone. In the cooling zone, the gas having stepwise lowering temperature is blown from one edge side of the object so that the gas passes the space between the adjacent objects (i.e., over the main surfaces of the object). When the gas is blown toward the objects which are stacked perpendicularly to the main surface of the object, both main surfaces of the objects are cooled rapidly.

In a preferable embodiment of the heating chamber of the heat treatment apparatus according to the present invention, an equalizing sheet (or a thermally equalizing sheet) is used.

The equalizing sheet is a sheet having a good thermal conductivity. A particularly preferable equalizing sheet is one having an anisotropic property in thermal conductivity and a good thermal conductivity. Such an equalizing sheet is likely to have a uniform temperature distribution over itself. Thus, when the equalizing sheet is used for the heating chamber of the heating apparatus, more uniform heat treatment is achieved than when the equalizing sheet is not used. In the present specification, the term "uniform heat treatment" is intended to estimate an extent of uniformity of the heat treatment based on the case in which no equalizing sheet is used. Thus, "more uniform heat treatment" means that the extent of uniformity of the heat treatment is improved relative to the case in which no equalizing sheet is used, and does not mean that perfectly uniform heating is possible.

The equalizing sheet has preferably a large thermal conductivity along a direction of the main surface of the sheet. For example, a metal having good thermal conductivity (such as copper), an inorganic material (such as glass and ceramic), and a carbon material may be used in the sheet form as the equalizing sheet.

As a particularly preferable embodiment, a graphite sheet is used as the equalizing sheet. The graphite sheet is heat resistant and has large thermal conductivity. Among the various graphite sheets, a highly oriented graphite sheet is preferable. The highly oriented graphite sheet is produced by calcination of a resin sheet material such as a polyimide resin so that it is made into a graphite form, and it is highly oriented and has a much larger thermal conductivity in its plane direction than in its thickness direction. In addition, it is resistant even at a temperature of not lower than 3000° C. Concretely, the graphite sheet which is disclosed in Japanese Patent Kokai Publication No. 3(1991)-75211 may be used as the above described graphite sheet in the present invention. The disclosure of this Publication is incorporated herein by reference.

In the heating chamber of the heat treatment apparatus according to the present invention, when the equalizing sheet is provided between the heating means and the object, the heat generated by the heating means is distributed uniformly over the whole sheet so that the object is uniformly and rapidly heated. Also, when the equalizing sheet is provided outside the heating means, heat emitted toward the outside of the heating means is distributed uniformly over the sheet, so that a whole surface of the equalizing sheet may uniformly heat the object placed inside of the equalizing sheet. As a result, the heat which would otherwise escape from the heating means into outside may be effectively used.

The equalizing sheets may be provided with one between the heating means and the object, and the other outside the heating means. The equalizing sheet is particularly effective when a heating means which produces locally high temperature heat (such as a flame) is used. Also, the equalizing sheet is effective in that non-uniform heating or thermal deformation is avoided when a heating means which produces high temperature heat is used so as to heat the object in a short period. Further, it is useful when the object as a whole is kept within a predetermined temperature range.

In addition, in one preferable embodiment, a heating means, which can provide an overall heat, is provided outside another heating means, which can locally heat. The equalizing sheet is provided between these two heating means. Concretely, in one useful embodiment, an electric heater is provided between the equalizing sheet and the object, and a conduit through which a heating medium passes is provided outside the equalizing sheet. In this embodiment, intense heat generated by heating medium is made uniform by the equalizing sheet so that object is heated uniformly, and an electric heater is used for precise temperature control, so that the object is easily heated to a predetermined temperature in the heating chamber. This embodiment is particularly effective for the thermally treating zone of the present invention.

The arrangement of the equalizing sheet is preferably such that it encloses the moving path of the object in the heating chamber. With such an arrangement, heat is uniformly supplied to the object inside of the heating chamber so that rapid and uniform heating of the object is possible.

In a more preferable embodiment, the equalizing sheet is doubly wrapped around the object and the heating means is provided between an inside turn and an outside turn of the equalizing sheet. In this embodiment, heat generated by the heating means is transferred to and distributed over the whole of the outside and the inside turns of the equalizing sheet, so that the whole object is heated uniformly by the whole equalizing sheet.

Heat may be supplied to a portion of the equalizing sheet, and such heat is distributed over the whole equalizing sheet by means of its peculiar property. In this embodiment, the heat is transferred to the object effectively even when the heating means as a heat source is not provided along, near or over the object, or its moving path in the heating chamber. The heating means may be positioned relatively apart from the object.

A wall structure of the heating chamber of the heating apparatus according to the present invention is formed using an insulation. The insulation may be made of any material which is conventionally used, and a structure of the insulation may be the same as a conventional one. As a material for the insulation, for example refractory brick, refractory glass, refractory ceramic and so on may be used.

The insulation preferably includes a high vacuum space in its inside. Since the high vacuum space inhibits heat transfer, such insulation has good insulation properties.

In one preferable embodiment, the insulation has an infrared reflection film on its surface. In this embodiment, heat energy which would otherwise permeate the insulation is effectively reflected by the film toward the object. As such an infrared reflection film, for example, a metal oxide film, an $SiO_2$/TaOx multi-layer, a ceramic film and so on which have a desired wavelength reflection properties may be used.

In another preferable embodiment, the insulation is in the form of a block, and the blocks are joined with each other. When the insulation is in such a block form, design and construction of the heating chamber becomes easy. Joining of the blocks may be achieved by fit and/or engaging. In another embodiment, the joining may be achieved using a connection fitting. For example, the blocks are fixed onto the wall of the heat chamber using metal fittings.

It is preferable to provide the equalizing sheet on an inside surface (i.e., a surface to face the object) and/or an outside surface (i.e., a surface opposite to the inside surface) of the insulation or the wall constructed by the insulation. Thus, when the insulation is formed by the insulation blocks, they may have the insulation sheet piece on their outer and/or inner surfaces.

In the heating chamber of the heating apparatus according to the present invention, the insulation preferably comprises a muffle structure which encloses the moving path of the object. The muffle structure may be the same as conventionally used in the heat treatment apparatus.

As to heating of the object in the heating apparatus according to the present invention, generally any heating means which is conventionally used may be employed. In one embodiment, flames are generated in the heating chamber by burning a combustible gas and the flames heat the object. When the flames are so generated that they directly face to the object, the heat of the combustion gas is effectively used by means of heat convection of and heat transfer through gas around the flames as well as heat radiation from the flames. In order to use the heat of the flames, burning openings are provided on the object moving path so that the combustible gas (such as hydrogen, LPG, town gas and so on) is supplied through the burning openings and ignited there, whereby the object passes over the flames.

For example, the burning opening is provided such that it is adjacent to the blowing opening for the floatage of the object and that the flame is formed along the gas expelling direction for the floatage, whereby the heat generated by the flame is effectively supplied to the object by means of the gas expelling stream.

In other embodiment, the combustible gas is burnt in another place rather than the heating chamber so as to form a combustion gas having a high temperature, which is supplied to the heating chamber, whereby the temperature of the heating chamber is increased. Instead of supplying the combustion gas into the heating chamber, gas in the atmosphere of the heating chamber may be heated by heat exchanging with the combustion gas, so that the temperature of the heating chamber may be increased.

In a further embodiment, as the heating means, an electrical heating means is used such as an electric heater, an infrared lamp and so on. The electric heater has an advantage in that it can rapidly and easily control an amount of generated heat by changing electric power supplied to the heater.

As another heating means, a conduit through which a heating medium passes may be used. This conduit is used with, as the heating medium, a high temperature gas, a high temperature oil and so on being passed so that heat of the heating medium is expelled outside through a wall of the conduit, and such heat is used for heating the object. Such a conduit produces intensive heat, and since the heating medium does not contact the object, it does not adversely affect the object.

Preferred Embodiments of the Invention

The present invention will be explained below further in detail with reference to the accompanied drawings.

FIG. 1 schematically shows a perspective view of a heating apparatus 1 which is used for the method of the prevent invention. The heating apparatus 1 comprises of a heating zone X, a thermally treated zone Y and a cooling zone Z. An object P in the form of a rectangular plate is supplied to the heating zone X, as shown with the arrow, is passed through the thermally treating zone Y and the cooling zone Z, and is discharged from the apparatus 1. The heating zone X and the thermally treating zone Y form a heating chamber 10 as shown. An air curtain is provided at the inlet of the heating chamber 10 so that the inside of the heating chamber 10 is shielded from its outside. For example, the shown apparatus may be used for calcination, firing or sintering of the object P comprising a glass substrate, a ceramic substrate, a metal substrate and the like on which a film forming material (such as silver paste, a material for a transparent conductive film such as $SnO_2$ and ITO (indium-tin oxide), a fluorescent material, a dielectric material, an insulating material, and a semiconductor material) has been applied.

For example, during the production of a plasma display panel, the apparatus may be used for various calcination or thermal treatment steps of various paste materials (such as silver paste, fluorescent material paste (e.g. R (red)/G (green)/B (blue) color emission material pastes), dielectric material paste (e.g., glass paste, MgO paste)) which are applied (for example by squeeze printing) onto a substrate in various production steps.

Figure 2:
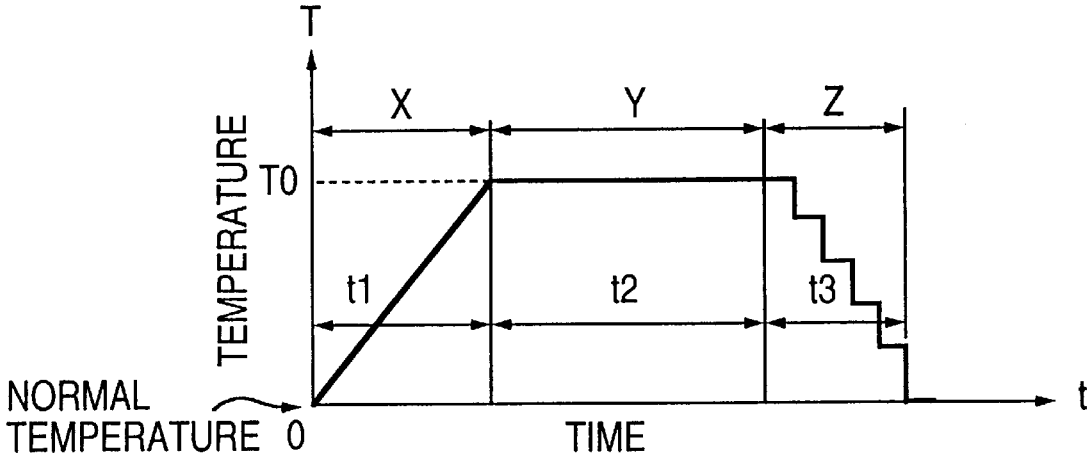
FIG. 2 schematically shows one example of a temperature curve for of the heat treatment of the present invention.

Conditions of the method of the heat treatment according to the present invention may include any appropriate temperature change. For example, as shown in FIG. 2, within the heating chamber 10 (namely, the heating zone X and thermally treating zone Y), the temperature of the object P is increased rapidly from a normal temperature to a predetermined temperature T0 (for example in a predetermined period t1) in the heating zone X, and thereafter the temperature T0 is kept (for example over a predetermined period t2) in the heating zone Y. After the heat treatment has been completed, the temperature of the object P is decreased stepwise as shown in the cooling zone Z (for example in a predetermined period t3), after which the object is withdrawn from the heat treatment apparatus.

Figure 3:
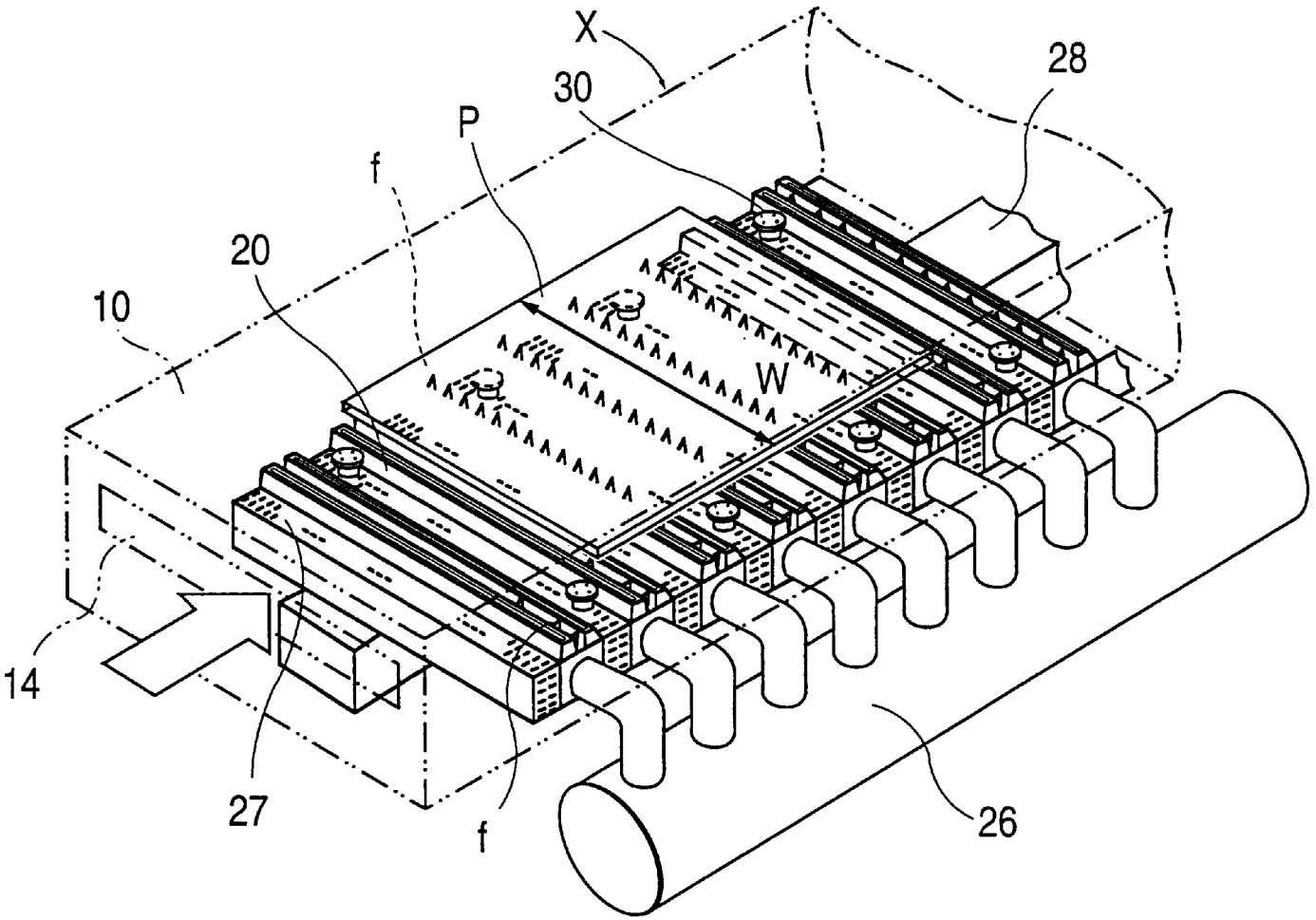
FIG. 3 schematically shows a perspective view of a heating chamber which is used in the heat treatment method of the present invention.

FIG. 3 schematically shows a perspective view of a portion of the heating chamber 10, which is used for the heat treatment of the present invention, such that the inside of the portion can be seen. The embodiment shown is preferable particularly for the heating zone X. The heating chamber 10 includes an inlet opening 14 having a width which is sufficient but not excessively wide to accept the object P (the similar is applicable to the height of the inlet opening). A plurality of and preferably many floating members 20 are provided separate from each other along a direction of the object movement (shown by the void arrow) in the heating chamber 10. Each of the floating members 20 is elongated along a direction perpendicular to the moving direction of the object, and the width of the floating member 20 (i.e., its longitudinal length) is longer than the width of the object P (W, a length of the object perpendicular to the moving direction).

An evacuation member 27 having a plurality of and preferable many evacuation openings is provided between adjacent floating members 20, so that the floating member 20 alternates with the evacuation member 27. One of the adjacent evacuation members 27 on the both sides of the floating member 20 has a suction means 30. The suction means 30 is provided around a position above which an edge portion of the object P is to be passed. The number of the suction means 30 and their arrangement may be appropriately selected as required. The evacuation member 27 has a width which is the same as that of the floating member 20, and the evacuation openings of the evacuation members 27 are connected to an exhaust duct 28 which is located below them. The floating member 20 has a slit(s) or a series of the blowing openings along a width direction of the object (see, the arrow W), as shown in FIG. 3. Gas is expelled from the slit or the blowing openings toward the object P so that it floats.

It is noted that as explained below, the floating member 20 has a row of the burning openings on its center portion along its longitudinal direction and flames "f" are generated from the openings. The evacuation member 27 has a plurality of evacuation openings along its longitudinal direction as shown, and the evacuation openings suck the gas from the heating chamber so that predetermined conditions (for example, a pressure, a amount of the gas and so on in the heating chamber) of the heating chamber are kept as required. The suction means 30 can halt the object which is moving as explained below.

Figure 4:
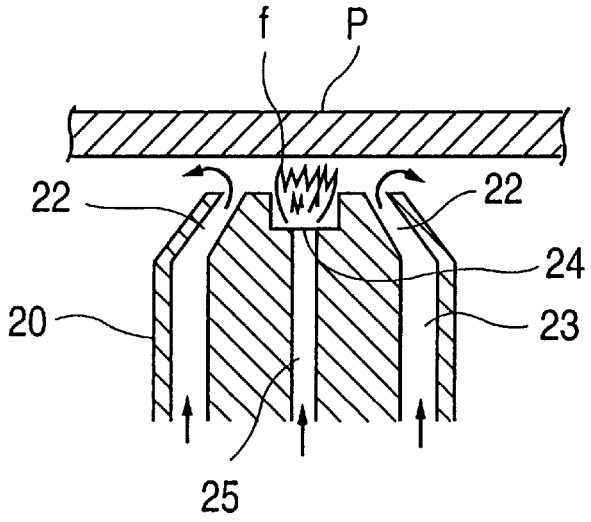
FIG. 4 schematically shows a cross-sectional view of a floating member.

FIG. 4 schematically shows a cross-sectional view of the floating member 20 (i.e., the cross-section which is perpendicular to the main surface of the object and which is parallel to the moving direction of the object). The floating member 20 includes, on its top, a burning opening 24 and blowing openings 22 on the both sides of the burning opening 24. As shown, the gas which flows through a passage 23 is expelled through the blowing opening 22 toward the object P which is above the opening 22. The passage 23 is connected to a gas supply conduit 26 which is located outside the heating chamber 10 (see FIG. 3). The gas supply passage 23 preferably supplies the gas such as air which has been preheated. Preheating of the supplied gas may be carried out by heat-exchanging with the gas which is evacuated from the heating chamber and this improves energy consumption. Alternatively, the gas evacuated from the heating chamber 10 is directly supplied to the heating chamber 10 through the gas supply conduit 26, so that the gas is re-used.

In the embodiment shown in FIG. 4, a pair of the blowing openings 22 expels the gas diagonally and center above the floating member 20, and the gas collides against the object P and then flows along the bottom surface of the object P outward as shown with the arrows. At that time, a floating force generated by the gas floats the object P.

Combustible gas is supplied to the burning opening 24 through a passage 25 from the outside of the heating chamber 10. The combustible gas is burnt to generate the flame "f" at the opening 24. The flame "f" is sandwiched by the gas streams expelled from the blowing openings 22 on the both sides of the burning opening 24, so that the flame substantially directly extends toward the object P. The flame "f" heats gas around the flame, and the object P is rapidly heated to a predetermined temperature or kept at a predetermined temperature by means of a heating function of the heated gas as well as a heating function of radiation heat ray from the flame "f." It is noted that the flame "f" also functions to heat the gas expelled through the blowing openings 22.

In the embodiments shown in FIGS. 3 and 4, the object P which is supplied into the heating chamber 10 through the inlet opening is floated by the gas expelled by the floating members 20 and heated by the flames from the burning openings 24. As shown in FIG. 3, the combustion gas from the burning openings 24 and the gas expelled through the blowing openings are evacuated to the outside though the evacuating openings of the evacuation member 27 and an exhaust duct 28. Heat energy contained in the evacuated gas may be recovered and used for heating the gas which is expelled against the object P or for heating gas which is used to cool the objects in the cooling zone as described below.

It is noted that in the shown embodiment, the floating member 20 merely floats the object P and it does not horizontally move or halt the object.

Figure 5:
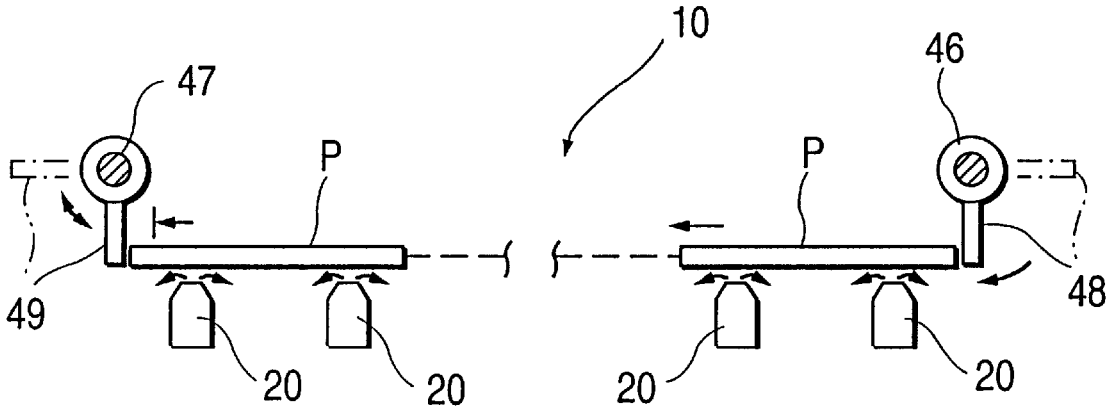
FIG. 5 schematically shows a moving path of an object when a moving object is viewed from a lateral side of the path.

FIG. 5 schematically shows a manner with which the floating object P is moved when the object P is viewed horizontally from a lateral side of the object P. In the embodiment shown in FIG. 5, the object P is to be moved from the right-hand side to the left-hand side. There is provided a pivotable push arm 48 at a right end of the moving path of the object P. The push arm 48 is provided on an axis 46 which is pivotally supported over a width of the heating chamber 10. By rotating the push arm 48 clockwise from its horizontal position (as shown with the two-dot-chain line) when the object P is present at the right end of the moving path (i.e., a condition of the right object P in FIG. 5), the arm 48 is positioned to abut with the edge of the object P. By further rotating the push arm 48, the arm pushes the object P toward the left direction, whereby the object is moved toward the left side. The object P, which is floating, is easily moved by lightly pushing. Depending on the length and a speed of the movement of the object P, a force applied to the object by the arm may be changed by means of the rotation speed of the axis 46. For example, the axis 46 may be rotated such that the arm 48 collides against the object or softly pushes the object.

In the embodiment shown in FIG. 5, a stop arm 49 is provided on a pivotable axis 47 at the left end of the moving path so that it can rotate around the axis 47. When the object P is moving, the arm 49 is perpendicular as shown, so that the object P approaching to the arm 49 is going to collide against the arm 49 and stops, whereby the object cannot move any more. In the case in which the movement of the object P is considerably fast, the arm 49 is set to rotate clockwise upon the collision with object so that it absorbs kinetic energy of the moving object. The object is not repelled by the stop arm 49 due to a reaction force.

By combining the above arms 48 and 49 properly, the object P can be easily moved toward a predetermined direction, the moving speed of the object P can be easily changed, or the moving object P can be easily halted.

Figure 6A:
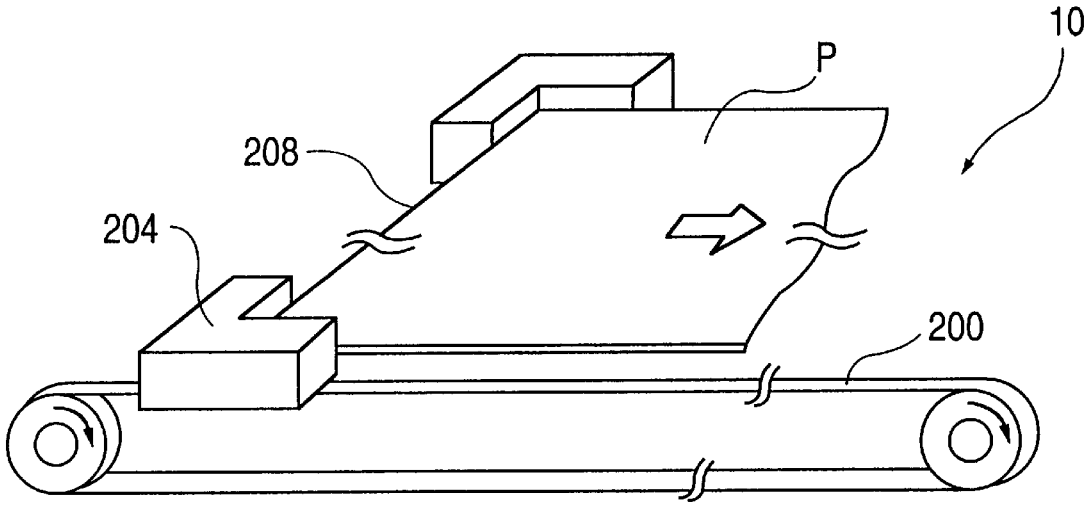
FIG. 6(*a*) and FIG. 6(*b*) schematically show a mechanism which moves a floating object using a mechanical force in a perspective and a plane view, respectively.
Figure 6B:
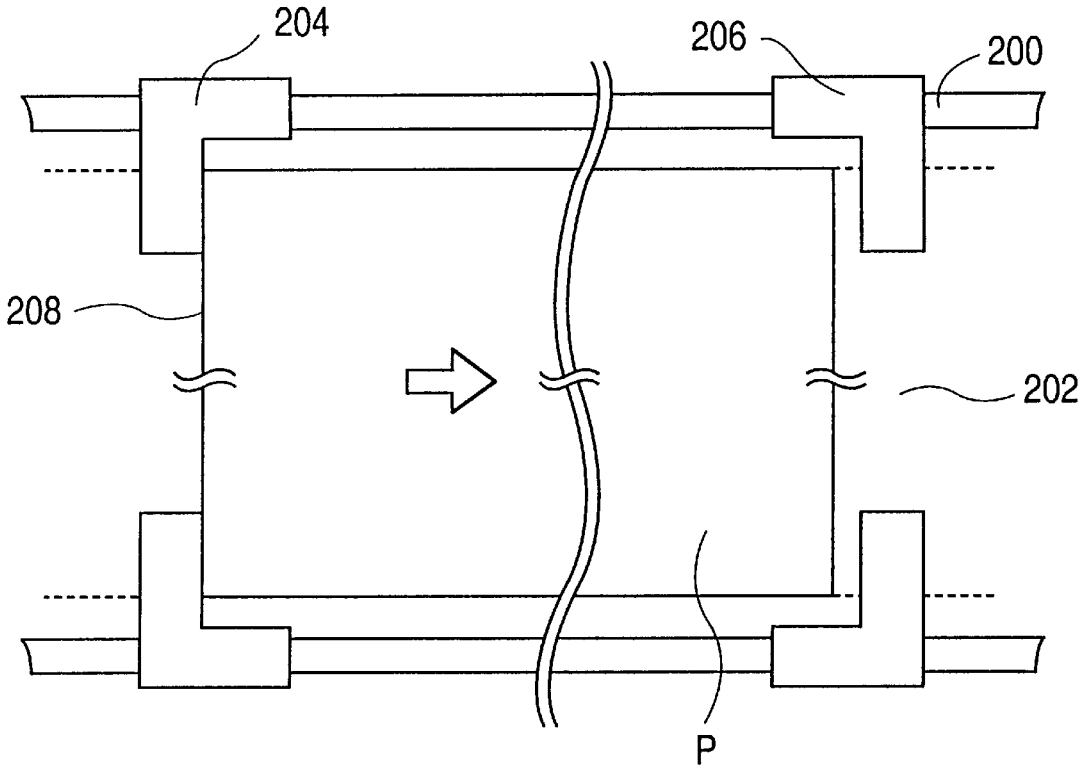

In a further embodiment of the method of the heat treatment according to the present invention, the object P, which is floating, is moved by a means of a mechanical force as schematically shown in FIG. 6. It is noted that FIG. 6(*a*) shows a perspective view and FIG. 6(*b*) is a plane view.

In FIG. 6, a driving means 200 such as a chain-belt or other belt is provided on each side of a moving path 202 of the object P and the driving means 200 moves (or travels) along a direction shown with the arrow. An abutting member 204, which abuts against the floating object P, is fixed to the driving means 200. When the driving means moves (or travels) along a direction which is the same as the moving direction of the object, the abutting member 204 pushes the object P so that the object P is moved. When the driving means 200 stops, the abutting member does not push the object any more, so that the moving object which is floated, stops. Thus, the object P is halted while it is floated. Such a driving means is provided in the heating chamber 10. Although the abutting member is provided at the rear edge of the object so that it can push the object toward a direction along which the object is to be moved, an additional abutting element 206 may be provided at the front edge of the object P, so that stopping of the object P is ensured.

At least one abutting element can perform its function, and depending on the object to be heat treated, the number of the abutting member(s) may be increased or decreased, and also the structure of the abutting element may be changed. Usually, the member 204 preferably abuts against the both ends of a rear edge 208 of the object P, and thus, two abutting members 204 are preferably used as shown in FIG. 6(*a*). When the object has a large width, an additional abutting element may be provided on a center portion of the rear edge 208. Alternatively, the two members 204 may be made integral together (i.e., made into a single member which pushes the whole rear edge 208).

When such a driving means is provided in the heating chamber 10, there are following advantages: only simple driving mean as such as a chain-belt or other belt has to be provided on the side(s) of the moving path of the object in the heating chamber; complicated facilities which generate and transfer power to the driving means may be provided outside the heating chamber; and the movement and the stopping of the object is carried out more reliably than in the case when the object is moved by the expelled gas and stopped by the suction means.

In another embodiment, a carrying member 210, which is floated by the expelled gas and supports the object therein, is moved in the heating chamber so that the object carried by the carrying member is heat treated. This manner is schematically shown in FIG. 7.

Figure 7:
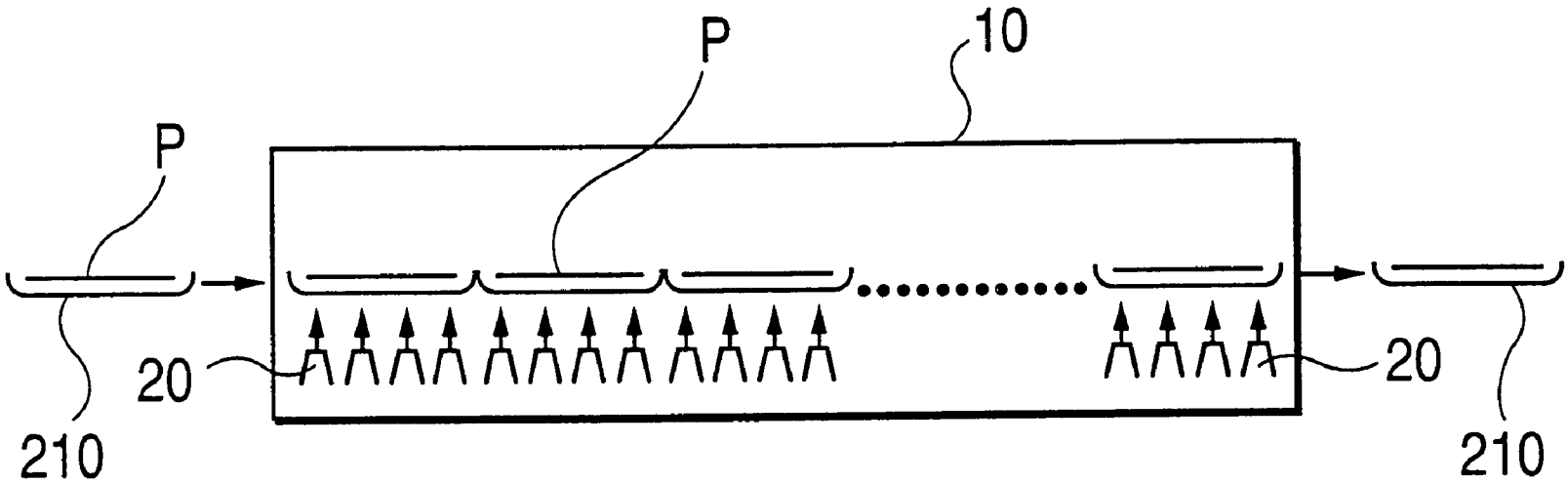
FIG. 7 schematically shows a mechanism with which a floating object is moved with a push mode.

A plurality of the carrying members 210, which may for example be in the form of a supporting tray as shown in FIG. 7, are arranged in a series so that they are adjacent and contact with each other. The objects P to be heat treated are placed in the carrying members 210. The carrying member 210 has a dimension (or a depth) which is relatively larger than the thickness of the object, so that when a force is applied to the last carrying member of the series of the members 210 toward a direction to which the object is to be moved, the force is transferred to its preceding carrying member and in turn to its further preceding carrying member and so on. Thus, the force applied to push the last carrying member ahead is transferred in turn to preceding members and finally to the front member, so that all the carrying members preceding the last member are moved. This kind of movement may be referred to as a push mode (or a plug flow mode). When this mode is used in the heating chamber 10, the object P supported by the carrying member 210 is moved in turn in the heating chamber 10, during which the object is heat treated. Since the carrying members 210 are floated by the gas expelled from the blowing openings 22 below the carrying member 210, the force required to move the carrying members is small. With the embodiment explained with reference to FIG. 6, when the object is displaced vertically or when the object does not have a sufficient thickness, there is a possibility that the abutting member 204, 206 does not abut against the object. To the contrary, in the embodiment shown in FIG. 7, since the carrying member 210 has the sufficiently large vertical dimension, the force is surely transferred between the adjacent carrying members 210. Thus, the embodiment shown in FIG. 7 is advantageous in that the possible problem with respect to the embodiment of FIG. 6 may be surely avoided.

Figure 8A:
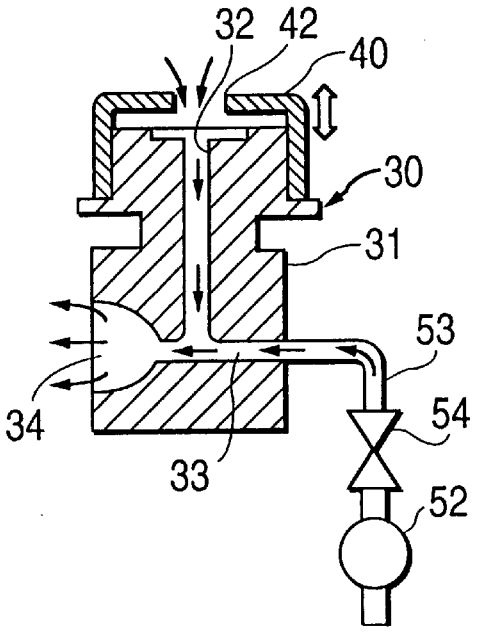
FIGS. 8(A), (B) and (C) schematically show an operation of a suction means in series of steps.
Figure 8B:
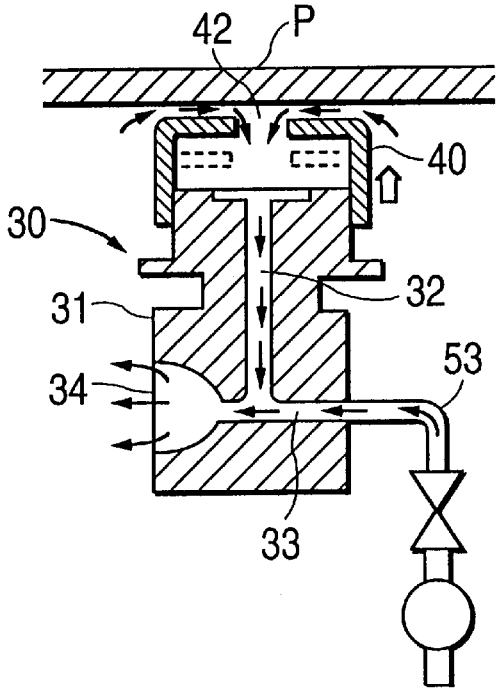
Figure 8C:
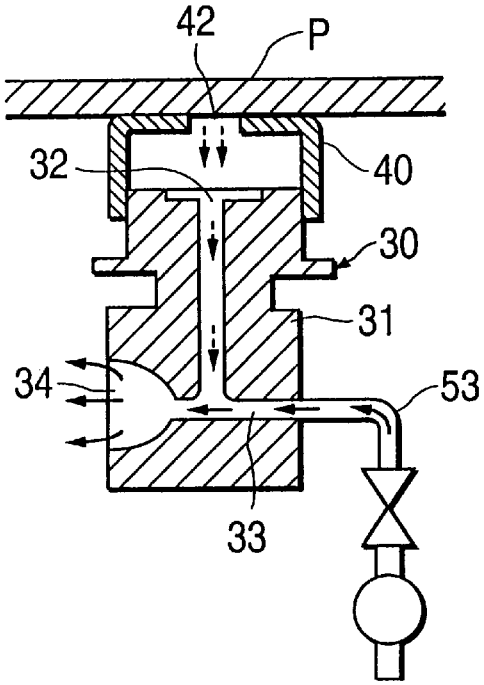

In another embodiment, the top of the object P which is moving may be carried out by using the suction means 30 as shown in FIG. 3. In order to explain operation of the suction means 30, cross-sectional views (cross-section perpendicular to the object and parallel to the object movement direction) of the suction means 30 are schematically shown in FIGS. 8(A) to (C). The suction means 30 includes a body portion 31 in the form of a column and a sliding member 40 in the form of a cap which is provided on a top end of the body 31. The sliding member 40 is attached to the end of the body such that the member 40 freely slide vertically upward and downward on the side surface of the body 31 as shown with the void arrow. The body member 31 contains a pressurized gas passage 33 which passes through the body member in its lower portion. The pressurized gas passage 33 is connected to a conduit 53 at its one end, and the conduit 53 is connected to a pump 52 through a control valve 54. The pump 52 and the valve 54 are provided outside the heating chamber 10. By operating the pump 52, the pressurized gas (such as air) is supplied through the pressurized gas passage 33. At the other end of the pressurized gas passage 33, an outlet opening 34 is present, through which the pressurized gas is discharged outside.

The body member 31 further contains a suction passage 32 in its center portion. The lower end of the suction passage is connected to the pressurized gas passage 33. The upper end of the suction passage is open at the top end of the body member 31. Above the upper end of the suction passage 32, a through hole 42 is provided in the center of the end surface of the sliding member 40.

The operation of the suction means 30 having the above described structure will be explained below.

As shown in FIG. 8(A), when the pressurized gas passes through the pressurized gas passage 33, the gas in the suction passage 32 is sucked. Then, the gas above the sliding member 40 is sucked through the through hole 42 of the sliding member 40.

As shown in FIG. 8(B), in the case where the object P is present above the suction means 30, the gas which is present between the bottom surface of the object P and the top surface of the sliding member 40 is sucked into the through hole 42 so that a gas stream is formed as shown with the arrows. The pressure of the gap between the object P and the sliding member 40 is reduced. Then, the sliding member 40 which is freely movable upward and downward is shifted toward the object P. When the sliding member 40 is moved upward, the gap between the object P and the sliding member 40 is further narrowed so that the gas stream gets faster and the pressure of the gap gets lower, whereby the sliding member 40 is further drawn toward the object P.

As shown in FIG. 8(C), when the sliding member 40 contacts with the bottom surface of the object P, the gas stream into the through hole 42 is no longer present. As long as the pressurized gas is supplied through the pressurized gas passage 33, the suctions effect of the gas through the suction passage 32 continues, so the sliding member 40 is strongly attached to the object P. Since the sliding member 40 which is provided on the body member 31 cannot move horizontally, the movement of the object P is stopped by means of friction between the sliding member 40 and the object P.

It is noted that when the pressurized gas supply is stopped, the suction effect is no longer present, so that the sliding member 40 is moved downward due to its weight. At this time, when the gas is expelled toward the object P through the blowing openings 22, the object P returns to its floating condition apart from the sliding member 40. In this condition, when some force is applied horizontally, the object is moved horizontally.

Such a suction means 30 can stop and disengage the object P only by controlling the supply and stop of the pressurized gas without a complicated mechanism in the heating chamber 10. Deletion of the complicated mechanism in the heating chamber leads to a stable operation of the heating chamber even at a high temperature.

Figure 9:
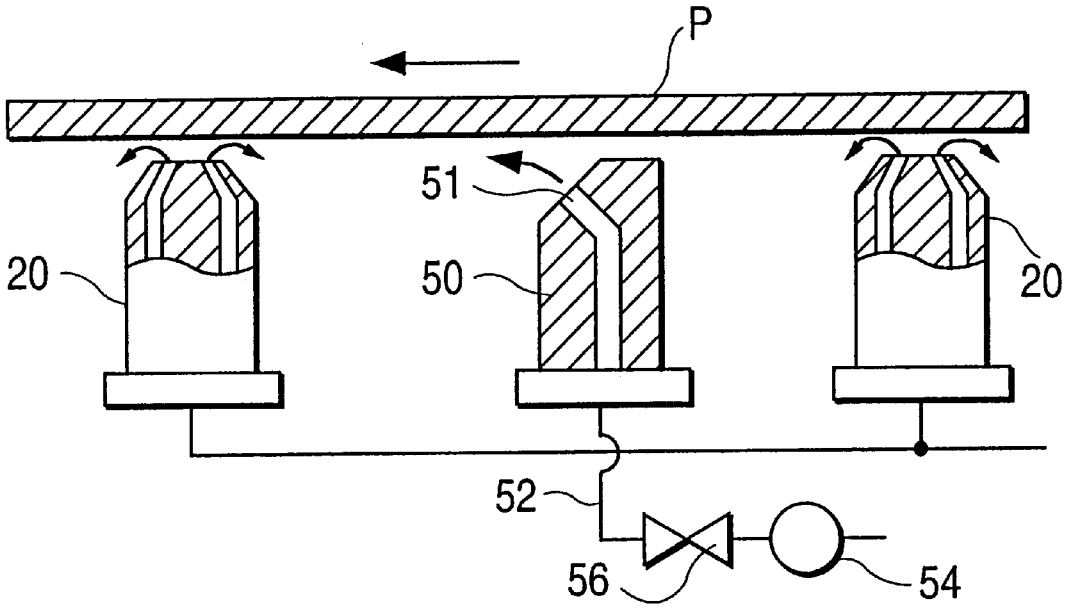
FIG. 9 schematically shows a cross-sectional view views of a gas blowing member which controls movement of an object.

In order to explain another embodiment in which the object is moved, FIG. 9 schematically shows a crosssectional view (cross-section perpendicular to the object and parallel to the object movement direction) of the gas blowing member.

A gas blowing member 50 expels gas diagonally toward the moving path (from right to left in the embodiment as shown with the arrow) of the object P (thus, from the lower right to the upper left). Concretely, the gas blowing member 50 is connected to a pump 54 through a conduit 52 and a control valve 56, and has a blowing opening 51 at the end thereof which diagonally faces to the object P.

When the valve 56 is opened and the gas is expelled from the blowing opening 51 toward the object P, a pressure is applied to the object along a direction from the lower right to the upper left, so that the object P is driven along a direction of a component force of the pressure which force is parallel to the object P (i.e. toward the left side in the shown embodiment). A component force which is perpendicular to the object P promotes the floatage of the object. When the valve 56 is closed, no gas is expelled so that the movement of the object is stopped. However, since the gas is expelled by the floating members 20 which are located on both sides of the gas blowing member 50, substantially only the floating side of the object P is kept. It is noted that when the valve 56 can control an amount of the gas to be expelled in addition to on/off functions of the gas supply, so that it can change the pressure of the expelled gas and thereby change the force to move the object (i.e., the driving force of the object).

Figure 10:
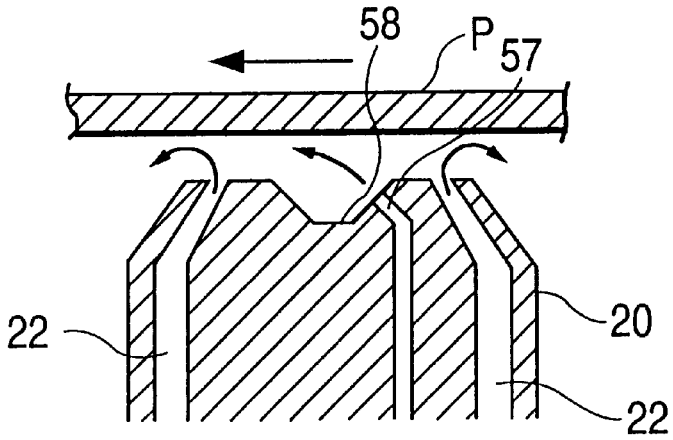
FIG. 10 schematically shows a cross-sectional view of a floating member including a gas blowing member.

In another embodiment, the gas blowing member 50 may be incorporated into the floating member 20. Such an embodiment is schematically shown in FIG. 10 in the cross-sectional view as in FIG. 9.

The floating member 20 contains in addition to two gas blowing passages 22, a gas blowing opening 57 which diagonally (from the lower right to the upper left) expels the gas between the two openings 22 so that it can control the movement of the object P. The blowing opening 57 opens on a side surface of a concave portion 58 at the top of the floating member 20.

It is noted that the blowing opening 57 may be in the form of a hole (for example circular hole) which is provided on a top of an overall column form, or in the form of a slit or a series of holes provided on a top of an elongated member. The blowing opening 57 exists below the object P over its width along a direction which is parallel to the object P moving direction and horizontal as shown in FIG. 3 (the slit embodiment).

An insulation structure will be explained which can be used in the heating chamber of the heat treatment apparatus according to the present invention.

Figure 11:
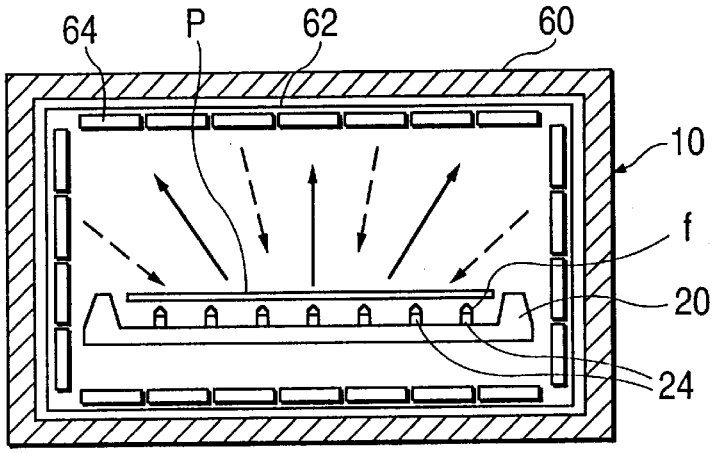
FIG. 11 schematically shows a cross-sectional view of a heating chamber of the heat treatment apparatus of the present invention.

FIG. 11 schematically shows a cross-sectional view (cross-section perpendicular to the object moving direction) of the heating chamber 10 of the heat treatment apparatus 1 of the present invention. In one embodiment, the heating chamber 10 of the heat treatment apparatus has an equalizing sheet 62 of a highly oriented graphite sheet which is affixed to the whole of an inner surface of a cylindrical outer wall 60. As the highly oriented graphite sheet, Panasonic graphite sheet (produced by Matsushita Electric Industrial Co., Ltd.) may be used, which has a thickness of for example 0.1 mm, a heat resistance above 3000° C. under the absence of oxygen, a thermal conductivity of 8.0 W/cm.°K (parallel to the sheet main surface, a thermal conductivity perpendicular to the sheet main surface is one hundredth (1/100) of that parallel to the sheet main surface), and a tensile strength of about 200 kg/cm$^2$. This sheet is flexible so that it can be curved and deformed. As a material for the outer wall 60, any material generally used for the conventional heating chamber of the heat treatment apparatus may be used. For example, stainless steel, Inconel, ceramic and quartz glass may be used.

Many insulation blocks 64 are overlaid on the inside surface of the equalizing sheet 62. In the space defined by the overlaid insulation blocks 64, the object P is moved while it is floated. The gas is expelled toward the bottom surface of the object P from the blowing openings provided in the floating members 20, whereby the object P is floated. Further, burning openings 24 provided in the floating members 20 form the flames "f", which heat the object P.

Figure 12:
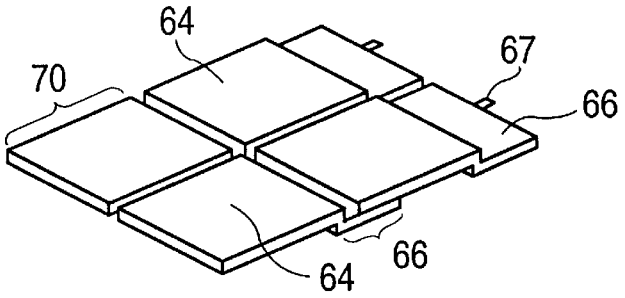
FIG. 12 schematically shows a perspective view of an insulation block.

FIG. 12 schematically shows a perspective view of a piece of the insulation block 64 as one example. The insulation block 64 has an overall rectangular shape when viewed from above in the shown embodiment. The block 64 may be for example a glass.

Figure 13:
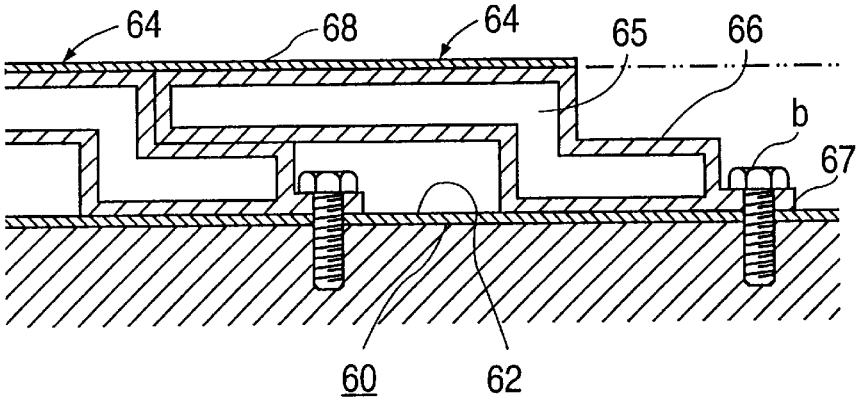
FIG. 13 schematically shows a cross-sectional view of the insulation block shown in FIG. 12 which is overlaid on an equalizing sheet on an outer wall of a heating chamber FIG. 14 schematically shows an insulating structure in which other insulation blocks are used.

FIG. 13 schematically shows a cross-sectional view of the insulation block shown in FIG. 12 when affixed onto the outer wall 60. The insulation block 64 has an inside space 65 which is shielded to keep a high vacuum condition therein. An infrared reflection film 68 is attached to a surface of the insulation block 64 which is to face the object.

The insulation block 64 comprises a first block portion 70 and a second block portion 66 which partially overlap with each other over their edge portions to form an integral insulation block 64. When such insulation blocks 64 are located to define the heating chamber 10, a portion of the first block portion 70 of the insulation block is placed on a portion of the second block portion 66 of an adjacent insulation block, so that the second block portion functions as a spacer. The second block portion 66 has a protruding portion 67 at its edge. As shown in FIG. 13, the insulation block 64 is placed on the equalizing sheet 62 on the outer wall 60, and the block is fixed by screwing a bolt "b" into the outer wall 60 through the protruding portion 67 and the equalizing sheet 62.

When the insulation blocks 64 are overlaid on the whole inside surface of the outer wall 60, the second block portions 66, the protruding portions 67 and the bolts "b" are all concealed under the first block portions 70 of the insulation blocks 64, so that the exposed surfaces of the heating chamber 10 are defined by the infrared reflection films 68 on the insulation blocks 64.

When the insulating structure as explained above is employed, a portion of the heat emitted from the flames is directly absorbed by the object P. The rest of the heat (and heat emitted from the object if any) is reflected by the infrared reflection films 68 of the overlaid insulation blocks, so that the object P existing inside is heated by the reflected heat. This results in that the heat energy being effectively used and heat loss to the outside being reduced.

The insulation block 64 having the vacuum space 65 therein effectively prevents heat from being lost to the outside. However, there is a possibility that heat is lost outside through the insulation blocks themselves and gaps between the insulation blocks. Further, there is a possibility that a large amount of heat may be supplied to only a portion on the inside of the wall formed by the insulation blocks 64 depending on the use of the flames "f" or location of arrangement of the object P. In this case, a large heat flux is formed which passes through that portion of the wall, so that there may locally exist a high temperature portion on the outside of the wall.

However, when the equalizing sheet 62 is provided as shown, the heat flux which passes through the insulation blocks 64 is absorbed by the equalizing sheet 62 and uniformly distributed over the sheet, whereby temperature of a portion of the outer wall 60 which portion would otherwise be at a high temperature is not increased. An amount of the heat loss through the outer wall 60 is proportional to a temperature difference between the outside and the inside of the outer wall 60. Thus, when the equalizing sheet 62 prevents that portion of the outer wall 60 from being at a high temperature, the heat loss through the outer wall is reduced. Further, when the temperature distribution of the inner surface of the outer wall 60 gets uniform by means of the equalizing sheet 62, temperature of the inside space formed by the insulation blocks 64 gets more uniform so that uniform heating of the object P is achieved.

Figure 14:
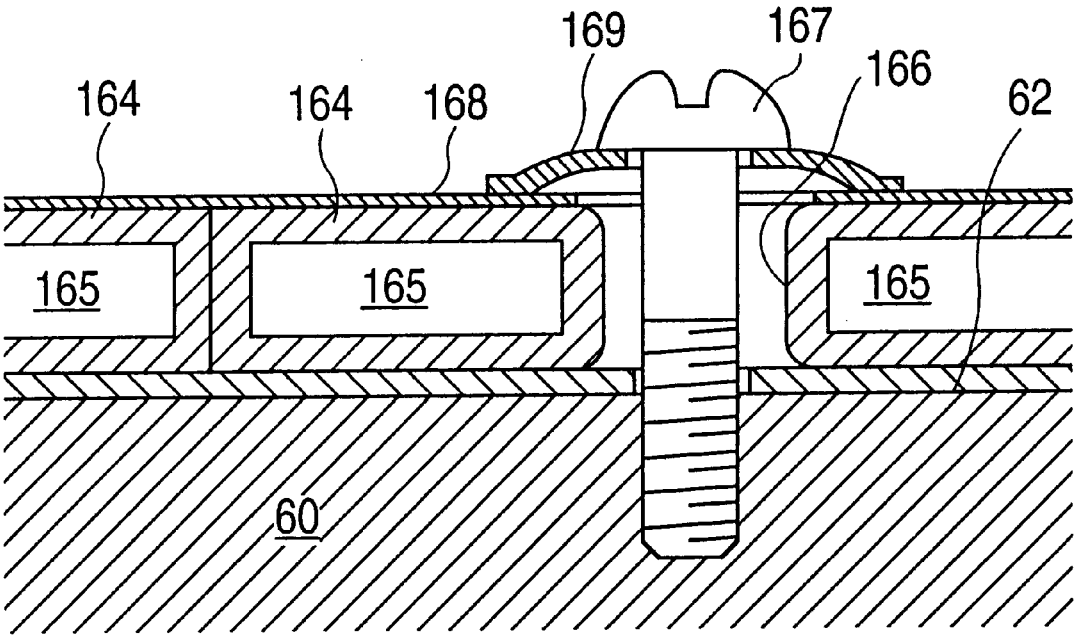

FIG. 14 schematically shows another insulation structure as in FIG. 13 in which another type of insulation blocks are used. The insulation block 164 shown has a rectangular plate form overall, and such blocks are overlaid on the equalizing sheet 62 on the inside of the outer wall 60. The insulation block 164 has a high vacuum space 165 in its inside. An infrared reflection film 168 is formed on the inside surface of the insulation block 164. The block 164 has a through hole 166 through which a fastening screw 167 is screwed into the outer wall 60 so that the insulation block 164 is fixed on the wall 60. The fastening screw 167 abuts against the insulation block 164 through a spacer 169 in the form of a disc. The spacer 169 is made of a material which has an insulation property such as a ceramic material. In the shown embodiment, the spacer 169 covers an opening of the through hole 166 so that heat loss toward the outside of the wall 60 is prevented.

Figure 15:
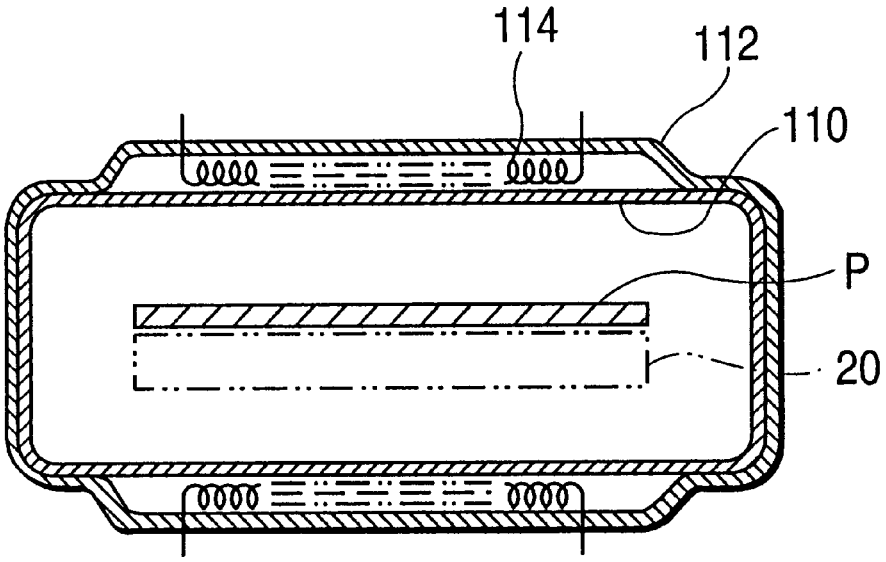
FIG. 15 schematically shows a cross-sectional view of another embodiment of a heating chamber of the heat treatment apparatus of the present invention.

FIG. 15 schematically shows a cross-sectional view (cross-section perpendicular to the object moving direction) of another embodiment of the heating chamber 10 of the heat treatment apparatus 1 of the present invention. It is noted that in the shown embodiment, the cylindrical outer wall which defines the periphery of the heating chamber and a wall formed by the insulation blocks are omitted.

In the embodiment of FIG. 15, an inner equalizing sheet 110 and an outer equalizing sheet 112 both of which are in a cylindrical form as shown are provided such that they surround the object P floated by the floating members 20. The equalizing sheets are provided around the object P in the doubly enclosing layer structure. There exists the outer wall 60 (not shown) around the equalizing sheet 112. There is provided an electric heater 114 in each of the upper and the lower spaces between the equalizing sheets 110 and 112.

In the embodiment of FIG. 15, heat generated by the electric heaters 114 is effectively transferred by the equalizing sheets 110 and 112 with less waste. That is, the equalizing sheets 110 and 112 transfer the generated heat rapidly over the whole of the sheets while the heat is distributed uniformly, and the equalizing sheet 110 uniformly emits heat towards the object P so that the object P is heated. As a result, the object is uniformly heated.

Figure 16:
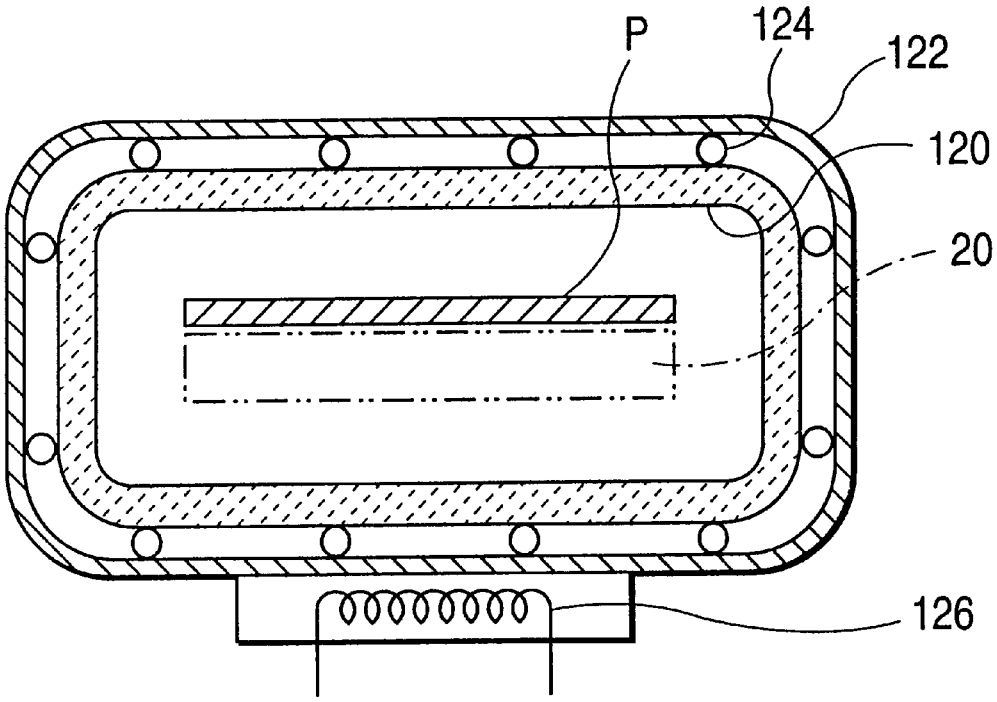
FIG. 16 schematically shows a cross-sectional view of a further embodiment of a heating chamber of the heat treatment apparatus of the present invention.

FIG. 16 schematically shows a cross-sectional view (cross-section perpendicular to the object moving direction) of another embodiment of the heating chamber 10 of the heat treatment apparatus 1 of the present invention. It is noted that in the shown embodiment, the cylindrical outer wall which defines the periphery of the heating chamber and a wall formed by the insulation blocks are omitted.

In the embodiment of FIG. 16, the equalizing sheet is combined with a muffle structure 120. The muffle structure 120 made of a metal such as SUS (stainless steel) in the form of a cylinder is provided such that it encloses the object P to be floated by the floating members 20 as shown. The equalizing sheet 122 is provided outside the muffle structure 120 through spacers 124 made of an insulating material. The outer wall 60 is provided outside the equalizing sheet 122, which is not shown. An electric heater 126 is provided outside below adjacent to the equalizing sheet 122.

Heat from the electric heater 126 is transferred to the equalizing sheet 122 and distributed over the whole periphery of the sheet uniformly. Thereafter, the heat is transferred to the muffle structure 120 by means of heat radiation from the equalizing sheet 122, and in turn the muffle structure 120 heats the object P placed in the inside space by means of heat radiation. The term "muffle structure" means a partition structure which separates the heating means such as an electric heater from the space in which the object is heat treated.

In the shown embodiment, the equalizing sheet 122 does not contact with the muffle structure 120 other than through the spacers 124. Thus, when the equalizing sheet 122 is heated, heat is transferred to only the equalizing sheet 122 having a small heat capacity so that it is rapidly heated. Radiation heat is transferred to the muffle structure 120 from the heated equalizing sheet 122 and the muffle structure 120 heats the object P. Thus, the object P is heated uniformly and rapidly from its whole periphery.

In the embodiments shown in FIGS. 15 and 16, the heating means such as an electric heater is located so as to partially overlap with at least a portion of the object P to be heat treated while keep some space between the heating means and the object. Such overlapping is not necessarily required, and in other embodiments the location of the heating means may be apart from the object P.

Figure 17:
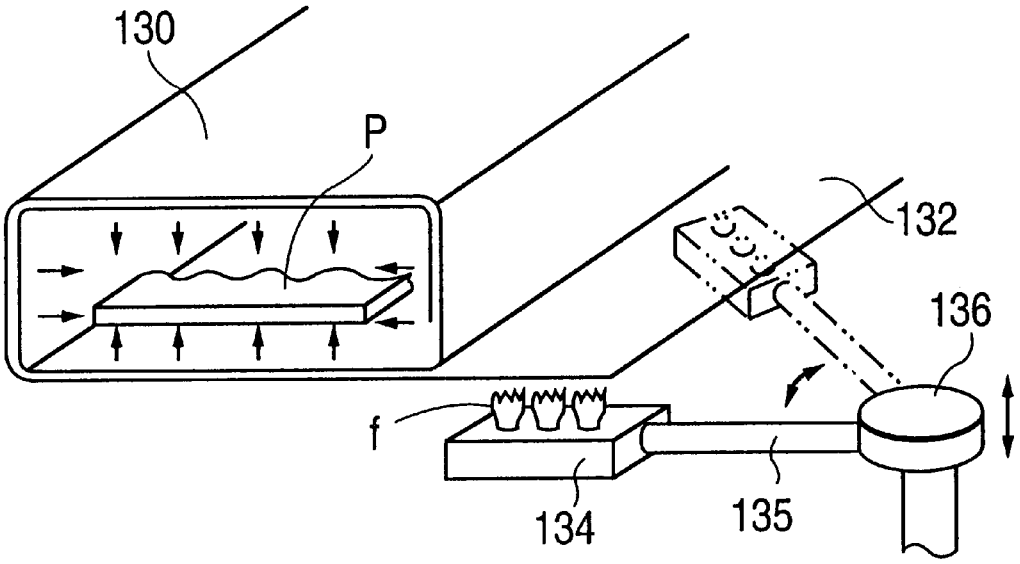
FIG. 17 schematically shows another heating mechanism in which an equalizing sheet is used.

Such an embodiment is schematically shown in FIG. 17 in which an equalizing sheet 130 enclosing the object P comprises a flap portion 132 which is apart form the object and which is to be heated.

For example, the equalizing sheet 130 is wrapped around a space around the object so as to form a cylindrical form (for example, to form a doubly wrapped form as shown in FIG. 17) and an end portion of the sheet is extended outward from the cylinder form to form the flap portion 132.

In the shown embodiment, a burner 134 is located below the flap portion 132. The burner 134 generates flames "f" and heats the flap portion 132. Heat supplied to the flap portion 132 is rapidly distributed over the whole equalizing sheet 130, which heats the space inside the sheet with heat radiation. As a result, the object P moving in the inside space is uniformly heated from its whole periphery.

The burner 134 is supported by a rotating axis 136 through an arm member 135. The axis 136 can pivot and vertically move as shown with the arrows.

A heating position to be heated by the burner 134 can be changed by rotating the axis 136, so that a heat transfer condition from the burner to the object P can changed. For example. The heating position of the burner 134 may be changed with the movement of the object P so that a specific portion of the object P may be strongly heated.

Further, when the burner 134 is vertically moved through the axis 136, a distance between the burner and the flap potion 132 is changed, so that an amount of heat to be transferred is adjusted, whereby the heat treatment temperature may be easily controlled. It is also possible to provide a mechanism which moves the burner parallel along the object movement path, and also to use other heating means rather than the burner may be used. For example, an electric heater may be used.

The structure of the insulation wall, which defines the heating chamber 10, is explained with reference to FIGS. 11 to 14. It may have another structure as schematically shown in FIG. 18 in a cross-sectional view of the wall.

Figure 18:
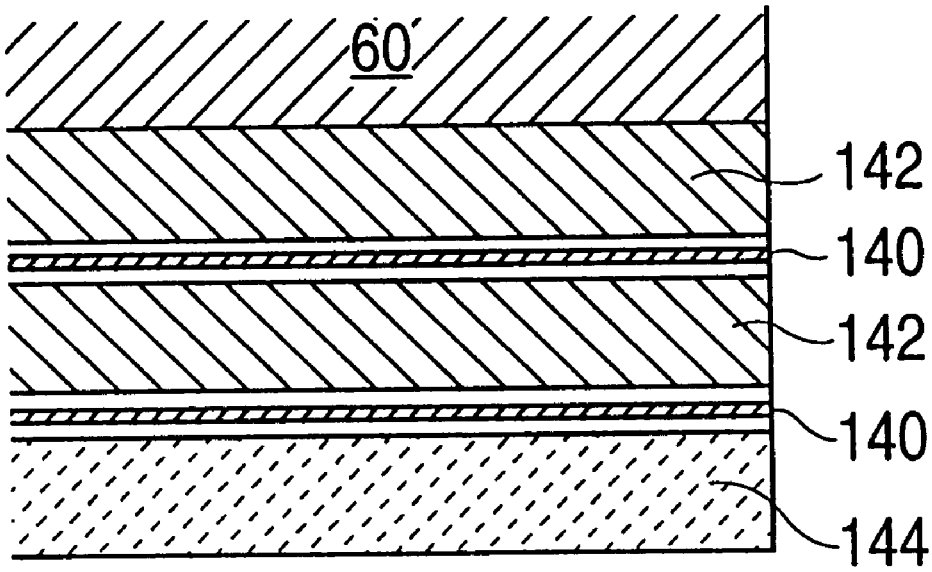
FIG. 18 schematically shows a cross-sectional view of an insulating wall which defines a heating chamber of the heat treatment apparatus of the present invention.

In the embodiment shown in FIG. 18, inside the outer wall 60, an insulation layer 142, an equalizing sheet 140, an insulation layer 142, an equalizing sheet 140 and a muffle structure 144 are provided in this order. The object P is moved inside the muffle structure 144. The heating means for the object P is separately provided. In the shown embodiment, two sets of the equalizing sheet 140 and the insulation layer 142 are provided, but the number of the set may be one or more than two.

In this embodiment, when heat generated in a space inside the muffle structure 144 is transferred to the equalizing sheet 140 through the muffle structure 144, the heat is rapidly distributed over whole periphery of the equalizing sheet and sheet temperature is averaged. The insulation layer 142 outside the equalizing sheet 140 prevents the heat from being lost outside.

Generally, when temperature of a portion of an insulation wall of the heating chamber gets locally high, heat is likely to be lost outside through that portion of the insulation wall due to a large temperature difference between the inside and the outside of the insulation wall. However, in the shown embodiment, the heat which is present in the locally high temperature portion is distributed by the equalizing sheet 140 over the whole sheet, so that such a locally high temperature portion is not readily formed. When such a locally high temperature portion is not formed, the heat loss through the insulation wall is reduced. As a result, overall heat energy loss from the heating chamber is reduced, which leads to effective utilization of the heat energy.

Figure 19:
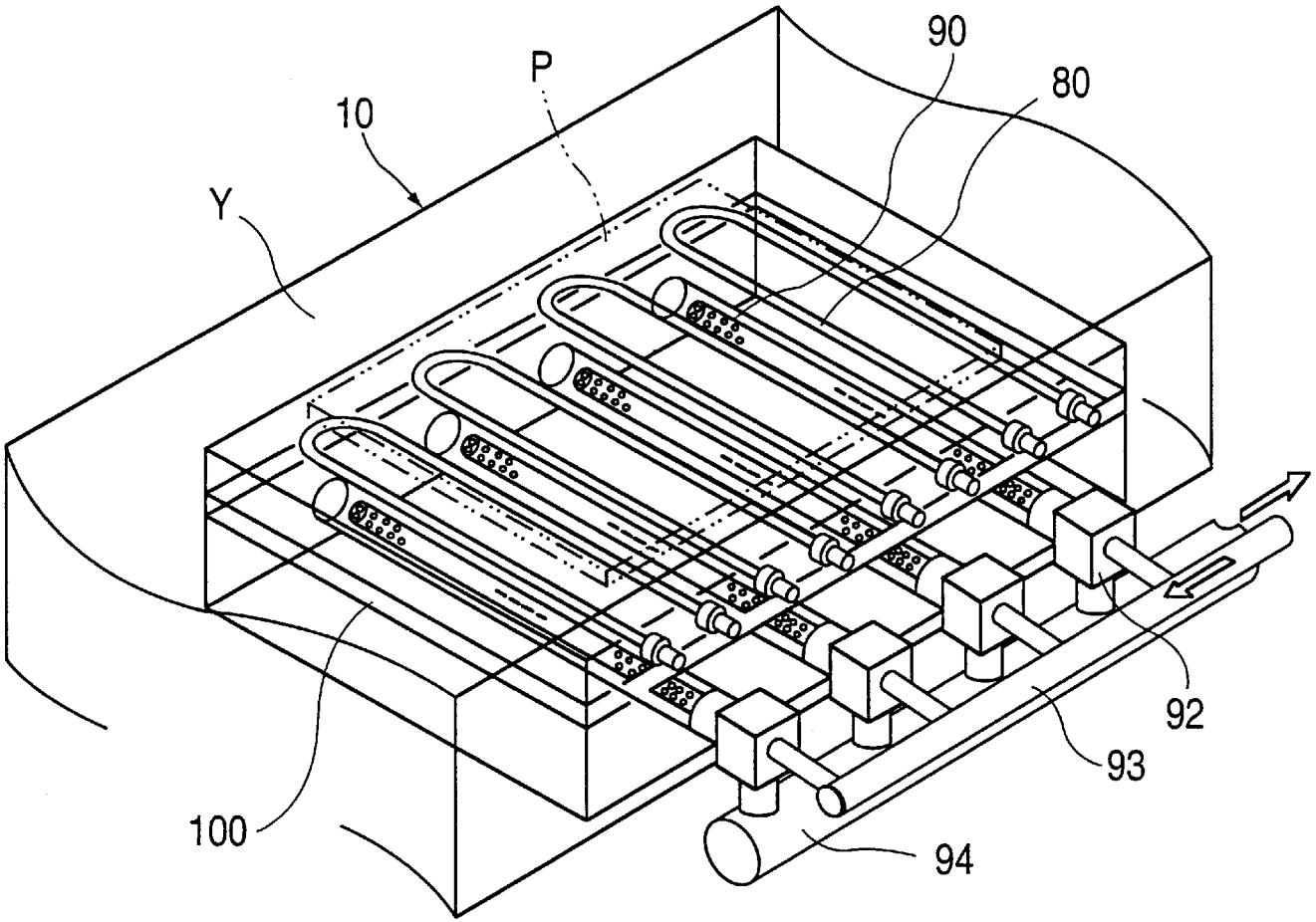
FIG. 19 schematically shows another embodiment of a heating chamber which is used in the present method of the heat treatment.
Figure 20:
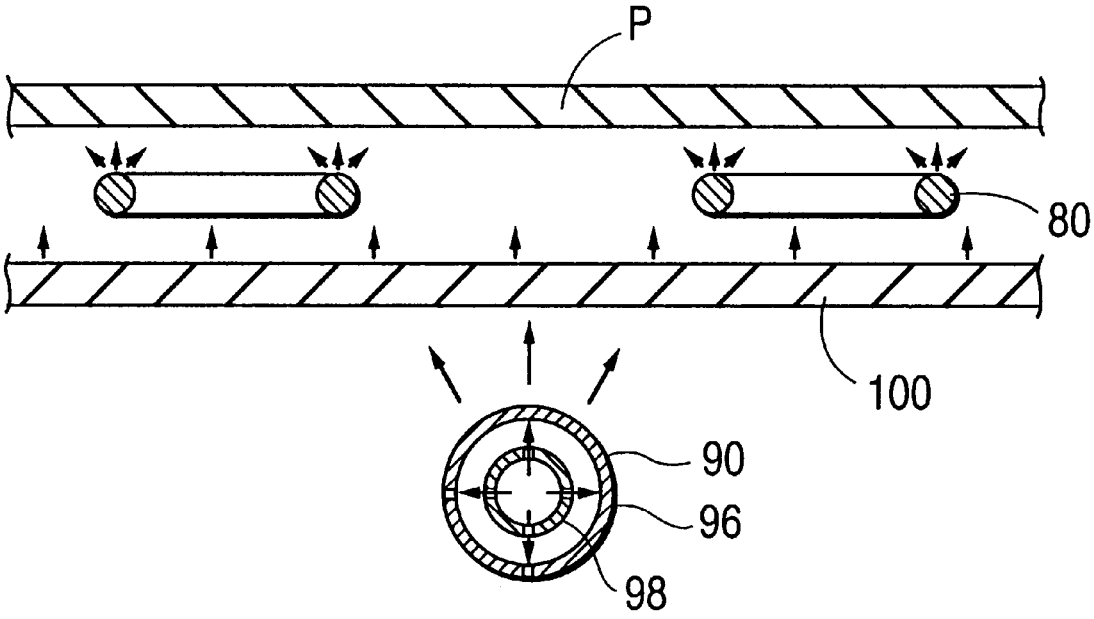
FIG. 20 schematically shows a cross-sectional view of the heating chamber of FIG. 19.

FIG. 19 schematically shows another embodiment of the heating chamber 10 which may be used in the present method of the heat treatment. Similarly to FIG. 3, FIG. 19 shows a perspective view so as to understand the inside of the heating chamber 10. The shown embodiment is particularly preferable for the thermally treating zone Y. It is noted that FIG. 20 schematically shows a cross-sectional view (cross-section which is parallel to the object movement and which is perpendicular to the object) of the embodiment of FIG. 19.

The insulating structure of the shown embodiment may be the same as that of the embodiment of FIG. 3. The embodiment of FIG. 19 also includes the object floating mechanism and the object moving mechanism which comprise the floating members 20 and the suction members 30 and so on (which are omitted from FIG. 19 merely for simplicity). When a large amount of heat is to be added as in the heating zone, the burning openings 24 shown in FIG. 4 may be provided. When a large amount of heat does not have to be added as in the thermally treating zone Y, the burning openings 24 may be omitted, and the floating members 20 as shown in FIGS. 9 and 10 may be employed.

As shown also in FIG. 20, electric heaters 80, which in plan view are U-shaped, are provided below the object moving path, and conduits 90 through which heating medium passes are provided below the electric heaters 80. Thus, the conduits 90 function as other heaters.

The conduit 90 has a double tube structure consisting of an outer tube 96 and an inner tube 98 having a number of through holes. As shown in FIG. 19, the inner tube 98 runs through the wall of the heating chamber 10 and is connected to an outside igniter 92. The igniter 92 is connected to fuel gas conduit 98 and an exhaust conduit 94 as shown. Fuel gas (or combustible gas) is supplied through the conduit 93 to the igniter 92 where it is burnt. The formed combustion gas is supplied into the inner tube 98, and then goes into the outer tube 96 through the holes of the inner tube 98. The outer tube 96 is connected to an exhaust conduit 94, and the combustion gas which has passed through the outer tube 96 is recovered from the conduit 94. When the combustion gas flows through the inner tube 98 and the outer tube 96, the heat of the combustion gas is emitted from the periphery surface of the outer tube 96 outward.

As shown in FIG. 20, the heat emitted from the conduit 90 is absorbed by the equalizing sheet 100. The heat is uniformly distributed over the whole sheet. Then, it is transferred upward with heat radiation to the object P which is located above the conduit 90, whereby the object P is heated.

In the embodiment shown, even though a large amount of heat energy is locally emitted from the conduit 90, the heat energy is uniformly distributed by the equalizing sheet 100 over itself and then the object P is heated, whereby the object P is uniformly heated. In addition, the electric heater 80, which is located substantially not to overlap with the conduit 90, supplies heat energy. The electric heater 90 also promotes the uniform heating of the object P.

Figure 21:
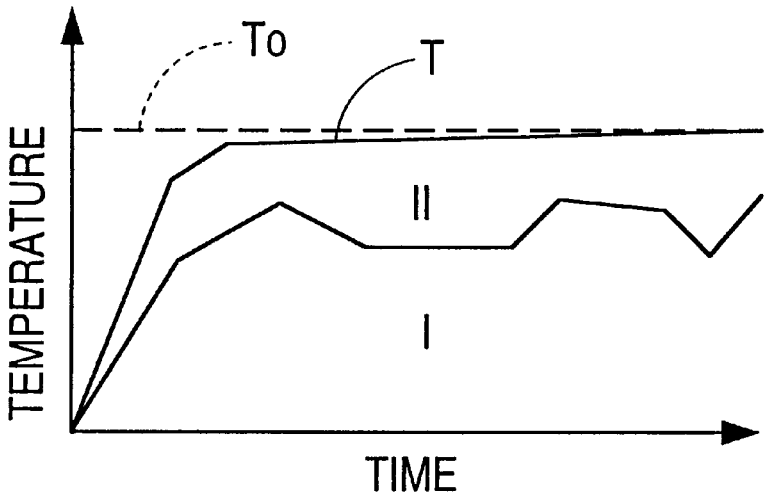
FIG. 21 schematically shows one example of a relationship between a heating time and an attained temperature T when an object is to be heated to temperature "T0"

In one preferable embodiment of the present invention, heat treatment temperature of the object is precisely controlled by using a combination of two kinds of the heating means (i.e., the electric heater 80 and the conduit 90 as described above). FIG. 21 schematically shows a relationship as one example between a heating time (t) and a temperature (T) attained in the heating chamber when an object P is heated to a predetermined temperature (T0). The attained temperature (T) corresponds to a result from the sum of an amount of heat supplied by the conduit 90 (represented by the area 1) and an amount of heat supplied by the electric heater 80 (represented by the area II). The bordering line between the area I and the area II means an attained temperature when only the conduit 90 is used.

When the conduit 90 is used for heating, temperature control is carried out by adjusting an amount of the supplied fuel gas. Since an amount of generated heat is so large, an amount of heat energy emitted from the combustion gas (and thus the heating temperature) is not rapidly changed and a time lag (i.e., a delayed response) is not avoidable when the amount of the supplied fuel gas is changed. Therefore, the heating temperature by the conduit 90 largely fluctuate. The electric heater 80 generates a relatively small amount of heat energy compared with the conduit 90, but an amount of generated heat energy is rapidly changed when an amount of supplied electric power is changed.

Thus, temperature increase by means of the conduit 90 is set a little lower than the predetermined temperature T0, and the difference from the increased temperature and T0 is compensated by heating of the electric heater 90. Then, the attained temperature easily and rapidly reaches the predetermined temperature T0, and thereafter the attained temperature is easily kept at the predetermined temperature T0 for a required period. As a result, the heating temperature of the object is precisely controlled, whereby heat treatment of high quality is ensured.

Figure 22:
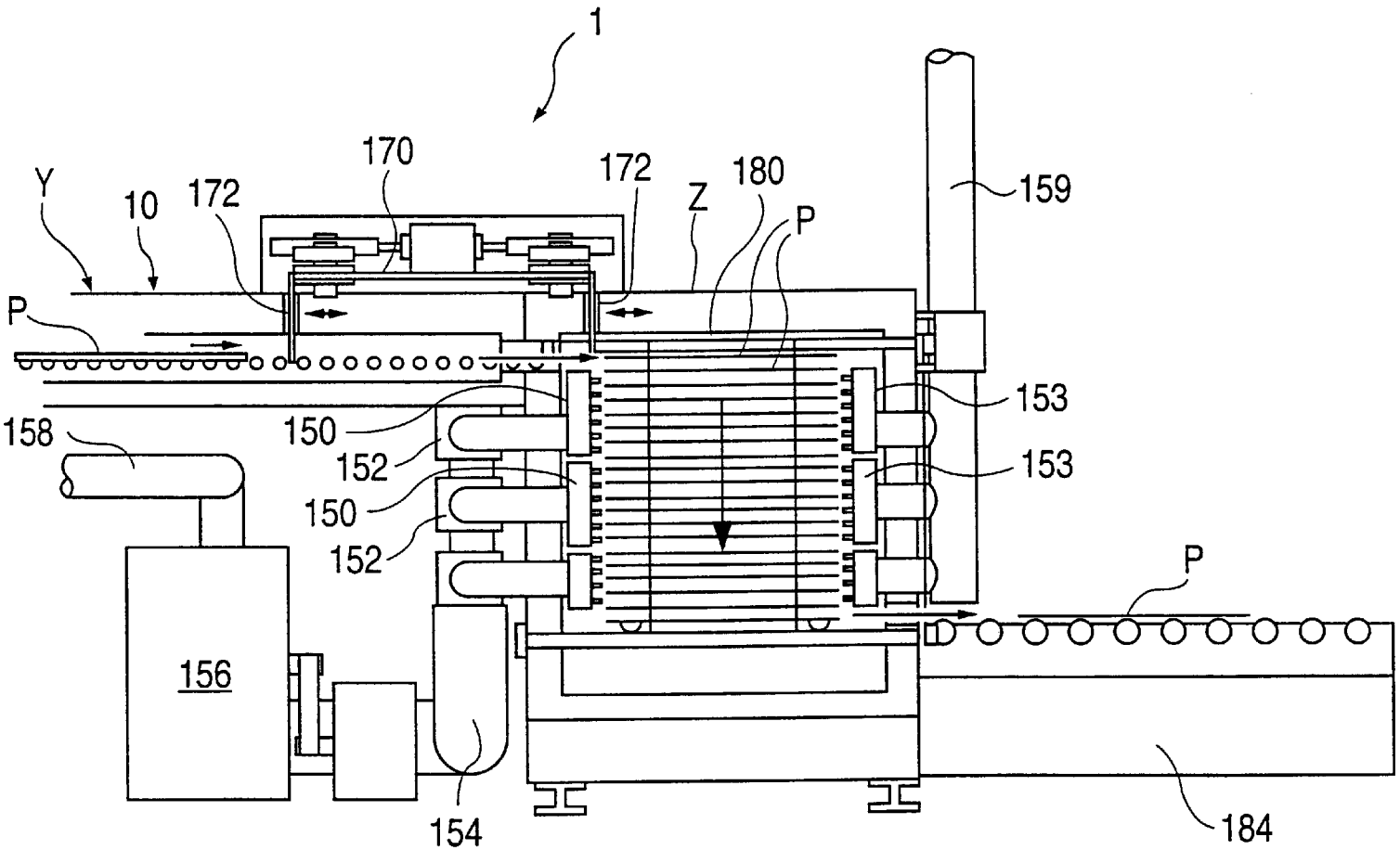
FIG. 22 schematically shows a cooling zone Z in a cross-sectional view together with a portion of a thermally treating zone Y.

As explained before, the heat treatment apparatus according to the present invention may comprise the cooling zone Z after the heating chamber 10. The cooling zone Z is schematically shown in FIG. 22 in its cross-sectional view together with a portion of the thermally treating zone Y. In the cooling zone, a gas of which has a temperature is lower than that of the object P is blown toward the object P so that the temperature of the object P is lowered.

In the embodiment shown in FIG. 22, there is provided between the thermally treating zone Y and the cooling zone Z, a pushing out member 170 which supplies the object P (which has traveled the thermally treating zone Y) to the cooling zone Z by horizontal movement of arms 172 of the pushing out member 170.

In the cooling zone Z, there is a conveyer 180 which moves the supplied objects P downward while they are stacked one on the other with a space between adjacent objects as shown in FIG. 22. The objects are gradually lowered while keeping the predetermined space between them.

There are provided blowing members 150 which have a plurality of blowing nozzles (or slits) along one side of a lowering path of the objects P as shown in FIG. 22. The blowing members 150 are connected to a blower 156 through heaters 152.

In the shown embodiment, the gas which has been used for heating in the heating zone X and/or the thermally treating zone Y and exhausted therefrom through an exhaust conduit 158 is supplied to the blower 156. Such gas may be supplied to the blower directly or after being heat-exchanged, then heated to a predetermined temperature by the heaters 152 if necessary, and then blown toward the objects P. When the gas is preferably at a lower temperature, the heating with the heaters 152 may be partially or totally omitted, and optionally, the gas may be mixed with another lower temperature gas.

In the shown embodiment, the heaters 152 arranged one on the other are operated such that the higher heater produces gas having a higher temperature. Thus, temperatures of the gas prepared by the heaters is downwardly lowered stepwise. For example, gas having a temperature of 350° C. is blown from the top blowing member 150, gas having a temperature of 300° C. is blown from the middle blowing member 150, and gas having a temperature of 200° C. is blown from the bottom blowing member 150.

There are provided evacuation members 153 having evacuation openings which are opposed to the blowing members 150. The evacuation members 153 are connected to an evacuation conduit 159.

Since the objects P, which go down in the cooling zone A have been often heated to a temperature of several hundred degrees Celsius, the gas blowing at a temperature of 350° C. cools the objects. As the objects are lowered, stepwise cooler gas is blown over the objects P, and the temperature of the objects P are gradually lowered. The object P which has reached the bottom of the cooling zone has been, which has been cooled to a temperature of for example 150° C., is then horizontally moved the outside of the heat temperature apparatus 1 and taken out by a conveyer 184 as shown in FIG. 22. The object P taken out of the heat temperature apparatus is optionally further cooled down naturally to an ambient temperature. The embodiment shown in FIG. 22 requires that the cooling zone Z has a small installation area which is a little broader than the area of object P. Further, since the gas is blown over the both sides (i.e., main surfaces) of the object P, the whole of the object P is effectively cooled.

When the object P is quenched after the heat treatment, cracking or deformation of the object P may occur during cooling. This happens probably because of the different cooling processes in different portions of the object so that the non-uniform temperature distribution arises over the object. Such a temperature distribution leads to different shrink behaviors of the object which result in stresses that cause the cracking and the deformation.

In the embodiment, described above, when the temperature difference is large between the gas blown from each blowing member and the object (i.e., each blown gas is at a temperature, and the object is greatly cooled by such blown gas), the whole object P is cooled uniformly and rapidly to a temperature which is determined by the blown gas temperature. Since the gas is effectively blown along the both sides of the object P, the whole object P is uniformly cooled, and thus temperature distribution of the object is likely to be uniform. Concretely, temperature difference between the highest temperature portion and the lowest temperature portion of the object P can be suppressed within several degrees Celsius. Thus, the problem of the cracking and the deformation is reduced.

For example, when a glass substrate having a size of one meter square is cooled using the above embodiment, a required time for cooling is not more than half of that for the conventional cooling method and further substantially neither cracking nor the deformation occurs. In addition, the heat of the exhaust gas from the heating chamber 10 may be used for heating the blown gas which is used for cooling, and thus the heat energy is effectively used.

Figure 23A:
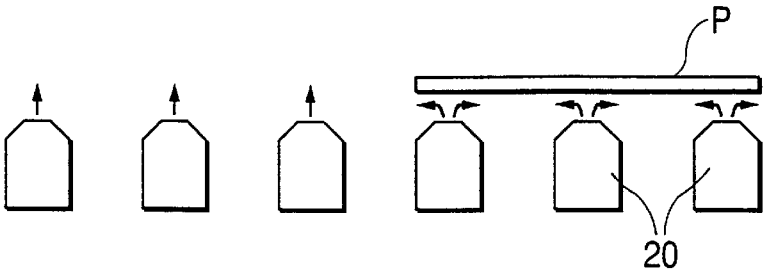
FIGS. 23(*a*), (*b*) and (*c*) schematically show in a series of steps, another embodiment of a manner which moves an object according to the method of heat treating the object of the present invention.
Figure 23B:
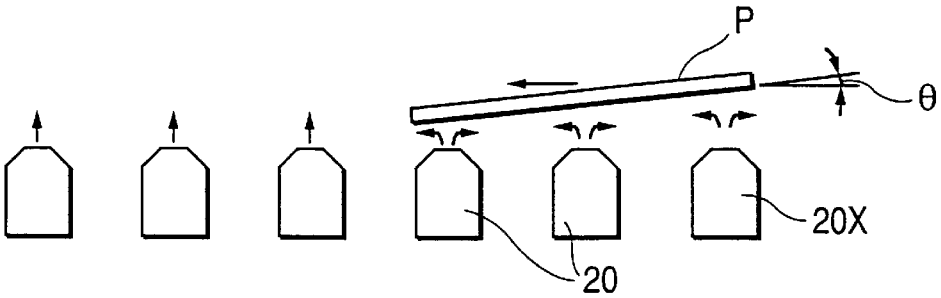
Figure 23C:
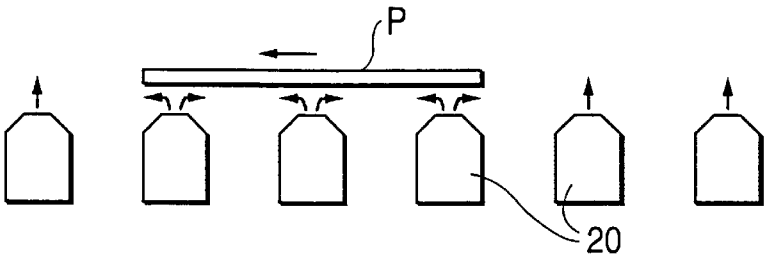

Another embodiment of the manner of moving the object in the method of heat treating the object is schematically shown in FIGS. 23(*a*) to (*c*) in which cross-sectional views along the object moving direction and perpendicular to the object are schematically shown. In the shown embodiment, the floating members 20 are used which are the same as those in FIG. 9. The floating member 20 expels the gas upward substantially perpendicular to the object P.

In the state shown in FIG. 23(*a*), the object is being floated by the gas expelled upward from the floating members 20, and is halted horizontally. Then, a pressure of the gas is increased which is expelled from the floating member 20*x* which is located below and around the rear edge portion of the object as shown in FIG. 23(*b*). For example, the pressure is increased to 120% relative to those of the other floating members 20. Then, the rear edge portion of the object P is shifted upward and inclined through an angle of θ as shown in FIG. 23(*b*).

When the object is inclined, an effect which moves the object P horizontally as shown in the arrow by means of the pressure applied to the bottom surface of the object P, so that the object begins to move toward the left hand side. It is noted that a driving (or advancing) force F (=mg.sin θ wherein m is a mass of the object, and g is acceleration of gravity) is formed from a view point of dynamics. Thus, merely by partially differentiating the pressure of the gas expelled upward from the blowing openings 20, the object can be moved horizontally.

As shown in FIG. 23(*c*), once the object moves, there is substantially little resistance against the movement of the object due to the floating state of the object, the object continues to move horizontally due to the inertial force over a considerable length. The pressure of the gas from the floating member 20*x* is then returned to its original condition. Therefore, the pressure from the floating member 20 which is below one edge of the object has to be kept larger so as to incline the object P for only a period up to start of the object movement.

Further, when the pressure from the floating member 20, which is below the rear edge portion of the horizontally moving object P is increased while the edge portion passes over the floating member, the driving force may be reapplied to the moving object so as to keep its moving speed in spite of air resistance. When the pressure is further increased, the moving speed of the object may be accelerated. By sensing passing positions and times of the object P using sensors and depending the sensing results, the pressures of the floating members 20 are controlled when the object passes over the floating members 20.

By using the above movement manner of the object, it is possible to change the speed and the direction of the object movement or to control the movement of the object so as to halt it. For example, when the pressure of the floating member 20*x* is changed in FIG. 23(*a*), the inclined angle θ is changed, so that the horizontally advancing force F, and thus the moving speed of the object is changed. Further, when the pressure of the floating member 20 which is located below and around the left edge portion of the object P is increased in FIG. 23(*b*), the object is inclined reversely to the state shown in FIG. 23(*b*) so that it can horizontally move toward the right hand side. In addition, when the pressure which applies to the front edge portion of the object moving horizontally is increased so that the front edge portion of the object is shifted upward, the force F acts reversely to function as a breaking force and thereby the movement of the object can be stopped.

Effects of the Invention

According to the heat treating method and the heat treatment apparatus of the present invention, the object is moved while the object is being floated by expelling the gas toward the object so that the mechanical structure such as a conventional conveyer which enters and leaves the heating chamber is not required and heat energy loss is suppressed. As a result, heat waste is reduced and energy efficiency is improved.

According to the present invention, only the floating mechanism and optionally the moving mechanism have to be equipped while the various mechanisms are omitted in the conventional apparatus. The number of the mechanisms in the heating chamber is greatly reduced, and thus dust generation problems due the presence of the mechanisms are also improved.

What is claimed is:

1. A method of heat treating an object, comprising:

floating the object in a heating chamber by expelling gas towards the object from below the object; and heat treating the object by directing heat from a separate heat source towards the object by said expelling gas.

2. The method according to claim 1, further comprising horizontally moving the object in a movement direction during said heat treating and said floating.

3. The method according to claim 2, wherein said horizontally moving the object includes blowing gas to move the object in said movement direction.

4. The method according to claim 3, wherein said blowing gas includes diagonally blowing gas from below the object.

5. The method according to claim 3, wherein the object includes a rear portion and a front portion with respect to said movement direction, said blowing gas includes blowing high pressure gas towards said rear portion of the object so that said rear portion shifts up relative to said front portion such that the object is inclined.

6. The method according to claim 2, wherein said horizontally moving the object includes applying mechanical force to the object.

7. The method according to claim 6, wherein said applying mechanical force to the object includes pushing the object along said movement direction.

8. The method according to claim 6, wherein said applying mechanical force includes driving a drive fixed to an abutting member so that said abutting member moves and pushing the object with said abutting member.

9. The method according to claim 8, further comprising stopping the object by stopping said drive so that said abutting member stops.

10. The method according to claim 6, wherein said applying mechanical force includes contacting directly adjacent carrying members, supporting the object with one of said adjacent carrying members, and pushing a last carrying member of said adjacent carrying members so that all of said carrying members move.

11. The method according to claim 2, further comprising stopping the object.

12. The method according to claim 11, wherein said stopping includes blowing gas to stop the object.

13. The method according to claim 12, wherein said blowing gas includes diagonally blowing gas from below the object in a direction opposite to said movement direction.

14. The method according to claim 12, wherein the object includes a rear portion and a front portion with respect to said movement direction, said blowing gas includes blowing gas towards said front portion of the object so that said front portion shifts up relative to said rear portion such that the object is inclined.

15. The method according to claim 11, wherein said stopping includes drawing gas through a suction opening below the object so that the object is drawn towards said suction opening.

16. The method according to claim 11, wherein said stopping includes colliding the object against a barrier member located downstream from the object in said movement direction.

17. The method according to claim 1, wherein said heat treating includes generating a flame to produce said heat from said separate heat source.

18. The method according to claim 1, further comprising cooling the object after said heat treating the object, wherein said cooling includes blowing a cooling gas having a lower temperature than the object towards the object.

19. The method according to claim 18, wherein said cooling includes stacking the object so that a main surface of the object is parallel to and spaced apart from another main surface of another heat treated object.

20. The method according to claim 1, further comprising applying a paste material to the object, wherein the object includes a plasma display panel, and wherein said heat treating includes calcining said paste material.

21. A method of heat treating an object, comprising:

floating the object in a heating chamber by expelling gas towards the object from below the object;

heat treating the object during said floating; and horizontally moving the object in a movement direction during said heat treating and said floating, wherein the object includes a rear portion and a front portion with respect to said movement direction and said horizontally moving the object includes blowing gas towards said rear portion of the object so that said rear portion shifts up relative to said front portion such that the object is inclined.

22. A method of heat treating an object, comprising:

floating the object in a heating chamber by expelling gas towards the object from below the object;

heat treating the object during said floating; and horizontally moving the object in a movement direction during said heat treating and said floating, wherein said horizontally moving includes contacting directly adjacent carrying members each of which is adapted to support the object, supporting the object with one of said adjacent carrying members, and pushing a last carrying member of said adjacent carrying members so that all of said carrying members move.

23. A method of heat treating an object, comprising:

floating the object in a heating chamber by expelling gas towards the object from below the object;

heat treating the object during said floating;

horizontally moving the object in a movement direction during said heat treating and said floating; and stopping the object, wherein the object includes a rear portion and a front portion with respect to said movement direction and said stopping includes blowing gas towards said front portion of the object so that said front portion shifts up relative to said rear portion such that the object is inclined.

24. A heat treatment apparatus for heat treating an object, comprising:

a heating chamber;

an object moving device provided in said chamber to move the object horizontally in a movement direction; and a floating member provided in said heating chamber, said floating member including a burning opening provided in said floating member to supply heat to the object, a first blowing opening and a second blowing opening, said first and second blowing openings being provided on opposite sides of said burning opening for expelling gas to float the object and to direct heat from said burning opening towards the object.

25. The apparatus according to claim 24, wherein said object moving device includes a moving device blowing opening provided in said object moving device to expel gas to move the object.

26. The apparatus according to claim 25, wherein said moving device blowing opening is adapted to diagonally expel gas to move the object horizontally.

27. The apparatus according to claim 25, wherein the object includes a rear portion and a front portion with respect to said movement direction and said moving device blowing opening is provided upstream from said first and second blowing openings to expel high pressure gas towards said rear portion of the object so that said rear portion shifts up relative to said front portion such that the object is inclined.

28. The apparatus according to claim 25, wherein said object moving device is provided as a part of said floating member.

29. The apparatus according to claim 25, wherein said object moving device is provided separate from said floating member.

30. The apparatus according to claim 24, wherein said object moving device includes a mechanical member provided in said object moving device to apply a mechanical force on the object.

31. The apparatus according to claim 30, wherein in said mechanical member includes a mechanical element provided in said heating chamber to apply said mechanical force horizontally on the object in said direction of movement so that said object moves horizontally.

32. The apparatus according to claim 30, wherein said object moving device includes a drive provided along at least one side of a movement path of the object in said heating chamber, and an abutting member fixed to said drive so that said abutting member moves along said movement path.

33. The apparatus according to claim 30, wherein said object moving device includes a plurality of carrying members each adapted to support the object, each of said plurality of carrying members are adapted to float above said floating member, and each of said plurality of carrying members are adapted to directly contact one another such that mechanical force can be transferred through said plurality of carrying members when said plurality of carrying members contact one another.

34. The apparatus according to claim 24, further comprising a stopper provided in said heating chamber to stop the object.

35. The apparatus according to claim 34, wherein said stopper includes a stopper blowing opening provided in said stopper to expel gas.

36. The apparatus according to claim 35, wherein said stopper blowing opening is adapted to expel gas diagonally in a direction opposite to said movement direction.

37. The apparatus according to claim 35, wherein the object includes a rear portion and a front portion with respect to said movement direction and said stopper blowing opening is provided downstream from said first and second blowing openings for expelling high pressure gas towards said front portion of the object so that said front portion of the object shifts up relative to said rear portion such that the object is inclined.

38. The apparatus according to claim 34, wherein said stopper includes a suction opening defined in said stopper to draw gas.

39. The apparatus according to claim 34, wherein said stopper includes a barrier member provided downstream in said movement direction in said heating chamber.

40. The apparatus according to claim 24, further comprising a cooling zone provided downstream in said movement direction from said heating chamber to expel cooling gas that has a lower temperature than the object towards the object.

41. The apparatus according to claim 40, wherein said cooling zone includes a stacker conveyor to stack the object so that a main surface of the object is parallel with respect to another main surface of another heat treated object.

42. The apparatus according to claim 41, wherein said cooling zone includes a first blowing member provided in said cooling zone to blow a first cooling gas at a first temperature over the object, a second blowing member located downstream from said first blowing member in said cooling zone to blow a second cooling gas at a second temperature, and an outlet, wherein said second temperature is lower than said first temperature in a stepwise fashion toward said outlet.

43. The apparatus according to claim 24, wherein said heating chamber includes an equalizing sheet provided in said heating chamber.

44. The apparatus according to claim 43, wherein said equalizing sheet includes a highly oriented graphite sheet.

45. The apparatus according to claim 24, wherein heating chamber includes a wall formed of insulation blocks, wherein each of said insulation blocks include a vacuum space formed therein.

46. The apparatus according to claim 24, further comprising the object wherein the object includes a plasma display panel and a paste material provided on said panel for calcining by said heat supplied by said burning opening.

47. A heat treatment apparatus for heat treating an object, comprising:

a heating chamber;

a floating member provided in said heating chamber to expel gas towards the object;

a heater provided in said chamber; and an object moving device provided in said chamber to move the object horizontally in a movement direction, wherein the object includes a rear portion and a front portion with respect to said movement direction, said object moving device includes a moving device blowing opening, and said moving device blowing opening is provided upstream from said first and second blowing openings to expel high pressure gas towards said rear portion of the object so that said rear portion shifts up relative to said front portion such that the object is inclined.

48. A heat treatment apparatus for heat treating an object, comprising:

a heating chamber;

a floating member provided in said heating chamber to expel gas towards the object;

a heater provided in said chamber; and a stopper provided in said heating chamber provided in said heating chamber to stop the object, wherein the object includes a rear portion and a front portion with respect to said movement direction, said stopper includes a stopper blowing opening provided in said stopper, and said stopper blowing opening is provided downstream from said first and second blowing openings for expelling high pressure gas towards said front portion of the object so that said front portion of the object shifts up relative to said rear portion such that the object is inclined.

49. A heat treatment apparatus for heat treating an object, comprising:

a heating chamber having an interior adapted to surround the object;

a floating member provided in said heating chamber to expel gas towards the object;

an object moving device provided in said chamber to move the object horizontally in a movement direction;

an equalizing sheet including a surrounding portion provided around said interior of said heating chamber and a flap portion extending apart from said surrounding portion; and a heater provided below said flap portion to heat said flap portion.

50. A heat treatment apparatus for heat treating an object, comprising:

a heating chamber including an equalizing sheet for absorbing and uniformly distributing heat provided in said heating chamber;

a floating member provided in said heating chamber to expel gas towards the object;

an object moving mechanism provided in said chamber to move the object horizontally in a movement direction; and a heater provided in said chamber.

51. The apparatus according to claim 50, wherein said heater is located outside said equalizing sheet.

52. The apparatus according to claim 50, wherein said heater is positioned in said heating chamber so that during operation said heater is located between the object and said equalizing sheet.

53. The apparatus according to claim 50, further comprising a second heater located outside said equalizing sheet, wherein said second heater includes conduit to conduct a heating medium, wherein said heater includes an electric heater.

54. The apparatus according to claim 50, wherein said equalizing sheet includes a highly oriented graphite sheet.

* * * * *